US008006960B2

(12) United States Patent
Okada et al.

(10) Patent No.: US 8,006,960 B2
(45) Date of Patent: Aug. 30, 2011

(54) NATURAL EVAPORATION HUMIDIFIER, HUMIDIFYING ELEMENT OF THE HUMIDIFIER, AND CASE FOR THE HUMIDIFIER

(75) Inventors: Kenji Okada, Kanagawa (JP); Kunihiro Kaneko, Kanagawa (JP)

(73) Assignee: Mikuni Corporation, Tokyo (JP)

( * ) Notice: Subject to any disclaimer, the term of this patent is extended or adjusted under 35 U.S.C. 154(b) by 927 days.

(21) Appl. No.: 10/593,562

(22) PCT Filed: Apr. 1, 2005

(86) PCT No.: PCT/JP2005/006457

§ 371 (c)(1),
(2), (4) Date: Sep. 20, 2006

(87) PCT Pub. No.: WO2005/098323

PCT Pub. Date: Oct. 20, 2005

(65) Prior Publication Data

US 2007/0182034 A1 Aug. 9, 2007

(30) Foreign Application Priority Data

Apr. 8, 2004 (JP) ..... 2004-113769
Mar. 31, 2005 (JP) ..... 2005-102515

(51) Int. Cl.
*B01F 3/04* (2006.01)

(52) U.S. Cl. ..... 261/72.1; 261/104

(58) Field of Classification Search ..... 261/72.1, 261/104, 107

See application file for complete search history.

(56) References Cited

U.S. PATENT DOCUMENTS 1,213,940 A * 1/1917 Parker et al. ..... 47/66.6
1,638,605 A * 8/1927 Thorson et al. ..... 261/104

(Continued)

FOREIGN PATENT DOCUMENTS

DE 296 03 429 U1 4/1996

(Continued)

OTHER PUBLICATIONS

Office Action dated May 12, 2009 for corresponding Japanese Application No. 2005-102515 and English translation thereof.

(Continued)

*Primary Examiner* — Scott Bushey
(74) *Attorney, Agent, or Firm* — Harness, Dickey & Pierce, P.L.C.

(57) ABSTRACT

One end of a humidify element 12 which has a plurality of humidify segments 24 connected to be free to extend and contract is fixed to a first case portion 28. One end of another humidify element 12 having the same structure is fixed to a second case portion 30. Each other end of the two humidify elements 12 is connected by a connect member 48. An inner space 42 as a water reservoir is formed at the first case portion 28 and the second case portion 30. At the time of non-usage, the first case portion 28 and the second case portion 30 are closed, and the humidify elements 12 and the connect member 48 are stored in the inner space 42. At the time of usage, the first case portion 28 and the second case portion 30 are opened, and the humidify elements 12 are extended. By supplying water to the inner space 42, one end of the plurality of humidify segments 24 is soaked in the water, and the whole humidify element 12 is moistened by capillary.

40 Claims, 25 Drawing Sheets

U.S. PATENT DOCUMENTS

| | | | | | |
|---|---|---|---|---|---|
| 2,018,274 | A | * | 10/1935 | Madden | 454/105 |
| 2,214,269 | A | * | 9/1940 | Bryant | 126/116 R |
| 2,717,148 | A | * | 9/1955 | Hall | 261/16 |
| 2,914,308 | A | * | 11/1959 | Bock, Jr. | 261/104 |
| 2,959,032 | A | * | 11/1960 | Davis | 62/314 |
| 3,136,829 | A | * | 6/1964 | Skerritt | 261/104 |
| 3,400,919 | A | * | 9/1968 | Schall | 261/102 |
| 3,954,920 | A | * | 5/1976 | Heath | 261/104 |
| 4,148,849 | A | | 4/1979 | Steiner | |
| 5,079,934 | A | * | 1/1992 | Vinokurov | 62/304 |
| 5,324,230 | A | | 6/1994 | Hist | |
| 5,399,299 | A | * | 3/1995 | Stengel et al. | 261/30 |
| 2004/0217494 | A1 | | 11/2004 | Lee | |
| 2005/0236723 | A1 | | 10/2005 | Lee | |

FOREIGN PATENT DOCUMENTS

| | | | |
|---|---|---|---|
| JP | S36-27033 | | 10/1961 |
| JP | S49-130053 | | 12/1974 |
| JP | S51-105253 | | 8/1976 |
| JP | 52-015866 | | 2/1977 |
| JP | 52-138349 | | 11/1977 |
| JP | S52-138349 | | 11/1977 |
| JP | S54-36357 | | 3/1979 |
| JP | S56-172617 | | 12/1981 |
| JP | S58-183422 | | 12/1983 |
| JP | 01-102227 | | 4/1989 |
| JP | 01-174835 | | 7/1989 |
| JP | U3022381 | | 12/1995 |
| JP | 11-223299 | | 8/1999 |
| JP | 11-224677 | | 8/1999 |
| JP | 2001-314217 | | 11/2001 |
| JP | 2003-252324 | | 9/2003 |
| WO | WO 03/048649 | A1 | 6/2003 |

OTHER PUBLICATIONS

European Search Report dated Jul. 1, 2010.
Office Action dated Jan. 18, 2011 for corresponding Japanese Patent Application No. 2009-163020.

* cited by examiner

NATURAL EVAPORATION HUMIDIFIER, HUMIDIFYING ELEMENT OF THE HUMIDIFIER, AND CASE FOR THE HUMIDIFIER

TECHNICAL FIELD

The present invention relates to a natural evaporation type humidifier which humidifies air by natural evaporation of water, a humidify element thereof, and a humidifier case thereof.

BACKGROUND ART

Conventionally, a natural evaporation type humidifier which does not need electric power is used to prevent air drying caused by heating equipment etc. in a room, for example. As shown in FIG. 25, a humidifier 220 of the prior art which is disclosed in Japanese Patent Laid-open H1-102227 comprises a humidify member 222, a water tank 224, a water bath 226, a cover 228, and so on. The humidify member 222 is made of absorptive synthetic resin etc. By soaking a part of the humidify member 222 (a suck portion 222*a*) in the water stored in the water bath 226, water is sucked by capillary and spread through the entire humidify member 222. The water sucked into the humidify member 222 naturally evaporates from the surface of the humidify member 222 (a humidify portion 222*b*) by touching with room air passing through a slit 230 formed at the cover 228, and humidifies the room.

However, the abovementioned humidifier 220 is impossible to carry around because of its complicated structure. The humidifier has to be downsized and lightened to be portable. However, to keep the desired humidifying amount, the number of the humidify members has to be increased or the size of the humidify member has to be enlarged. In this manner, the humidifying capability is contradictory to downsizing and lightening of the humidifier. Since downsizing and lightening are extremely difficult, being portable was impossible. Further, the bigger the humidify member is, the more difficult the moistening is at a portion apart from the soaking position. Therefore, there arises a problem such as difficulty in rapid humidifying because it takes time to moisten the entire humidify member. Moreover, since the abovementioned humidifier 220 is expensive, it is not easy to buy and install. For example, at a business hotel etc. where the room rate is relatively inexpensive, there are few rooms with a humidifier. Further, since popularly installed air-conditioners etc. such as heating equipment are unable to adjust humidity, impairing health such as damaging the throat due to drying of room air etc. caused by an air-conditioner etc. often occurs especially in the winter season. In such cases, if the guest brings a portable humidifier, the health problems can be solved.

The present invention was devised in view of the abovementioned problem. The object is to provide a natural evaporation type humidifier which has enough humidifying capability and which is less expensive and portable, and a humidify element thereof and a humidifier case thereof.

DISCLOSURE OF THE INVENTION

To achieve the abovementioned objects, the natural evaporation type humidifier comprises a humidify element which is absorptive, and a case which is free to open and close having an inner space where the humidify element is stored. In the humidifier of the present invention, the humidify element deforms and extends when the case is opened. In the humidifier of the present invention, the position of the humidify element changes when the case is opened. In the humidifier of the present invention, the humidify element is free to attach to and detach from the case. In the humidifier of the present invention, a slit or a notch is formed at the humidify element. In the humidifier of the present invention, the slit or the notch is wave-shaped. In the humidifier of the present invention, the inner space is a liquid reservoir to store liquid for moistening the humidify element. In the humidifier of the present invention, the humidify element comprises a plurality of humidify segments which are connected by a connect portion, and a part of every humidify segment is soaked in the liquid in the liquid reservoir. In the humidifier of the present invention, the connect portion to connect the plurality of humidify segments is a plurality of fold portions, and the plurality of humidify segments are bellows-shaped by folding the plurality of fold portions. In the humidifier of the present invention, a slit or a notch is formed at the position of the fold portion of the humidify element. In the humidifier of the present invention, the slit or the notch is wave-shaped. In the humidifier of the present invention, the case comprises a first case portion having a first open retaining engage means and a second case portion having a second open retaining engage means to engage with the first open retaining engage means, and the first case portion and the second case portion are fixed by engaging the first open retaining engage means and the second open retaining engage means when the first case portion and the second case portion are opened. In the humidifier of the present invention, the case comprises a first case portion and a second case portion, and the inner space for storing the humidify element is formed at both the first case portion and the second case portion, and one end of the humidify element is fixed being free to attach to and detach from the first case portion, and the other end of the humidify element is fixed being free to attach to and detach from the second case portion. In the humidifier having two of the humidify elements of the present invention, one end of one humidify element is fixed to the first case portion, and one end of the other humidify element is fixed to the second case portion, and the other ends of the humidify elements which are not fixed to the case are connected by a deformable connect member. In the humidifier of the present invention, the case comprises a first case portion and a second case portion, and one end of the humidify element is attached to the first case portion, and the other end is attached to the second case portion, and a water receive portion is disposed as a liquid reservoir made of water-repellant material being free to extend and contract as one end is attached to the first case portion and the other end is attached to the second case portion. In the humidifier of the present invention, the humidify element is free to attach to and detach from the first case portion and the second case portion. In the humidifier of the present invention, the water receive portion is free to attach to and detach from the first case portion and the second case portion. In the humidifier of the present invention, a second locating means is formed in the case to engage with the humidify element, and a first locating means is formed at the humidify element to engage with the second locating means. In the humidifier of the present invention, a blower is disposed at the vicinity of the humidify element, and the humidify element receives the wind from the blower.

The humidify element of the present invention comprises a plurality of humidify segments by folding a sheet-shaped absorptive member. In the humidify element of the present invention, the plurality of humidify segments are displaced having the folded position as a boundary. In the humidify element of the present invention, a slit or a notch is formed at the humidify segment. In the humidify element of the present invention, a center fold portion along which the sheet-shaped member is folded into two is formed as a zigzag shape. In the humidify element of the present invention, a slit is formed along the center fold portion. In the humidify element of the present invention, a plurality of humidify segments are disposed which are defined by the center fold portion and a plurality of sectional fold portions, and the member folded into two along the center fold portion is folded approximately perpendicular to the center fold portion at the plurality of sectional fold portions into a bellows shape. In the humidify element of the present invention, a slit or a notch is formed at the sectional fold portion. In the humidify element of the present invention, the slit or the notch is wave-shaped. In the humidify element of the present invention, the folding direction changes every time the center fold portion crosses the sectional fold portion. The humidify element of the present invention comprises a connect segment which connects to at least one humidify segment for binding up one end of all the plurality of humidify segments, a first engage means which is formed at the connect segment, and a second engage means which is formed at least at one humidify segment for engaging with the first engage means. In the humidify element of the present invention, the first engage means is one of an insert segment and a slit, and the second engage means is the other of an insert segment and a slit.

Another humidify element of the present invention comprises a plurality of absorptive humidify segments which one end is connected by a connect portion. In the humidify element of the present invention, a slit or a notch is formed at the humidify segment. In the humidify element of the present invention, the slit or the notch is wave-shaped.

The humidifier case of the present invention comprised an inner space to which a humidify element is stored, and a link portion to which the humidify element is fixed being free to attach and detach. In the humidifier case having a first case portion and second case portion of the present invention, the link portion is formed at least at either the first case portion or the second case portion, being an arm portion to sandwich a part of the humidify element by forming a gap with an inner wall of the case portion. The humidifier case of the present invention comprises a first closure retaining engage means which is disposed at the first case portion to retain a state that the case is closed, and a second closure retaining engage means which is disposed at the second case portion to engage with the first closure retaining engage means. In the humidifier case of the present invention, the first closure retaining engage means is a deform member which is displaced by external force, and the second closure retaining means is a projection which is disposed at a cover, and the projection links with and unlinks from the deform member in accordance with the displacement of the deform member. The humidifier case of the present invention comprises a first open retaining engage means which is disposed at the first case portion to retain a state that the case is opened, and a second open retaining engage means which is disposed at the second case portion to engage with the first open retaining engage means. In the humidifier case of the present invention, one of the first case portion and the second case portion is a reservoir which has the inner space, and the other is a cover to open and close the opening portion of the reservoir, and a liquid discharge gap for connecting the inner space with outside is formed at the reservoir. In the humidifier case of the present invention, one of the first case portion and the second case portion is a reservoir which has the inner space, and the other is a cover to open and close the opening portion of the reservoir, and a retain means for retaining the humidify element is formed in the reservoir. In the humidifier case of the present invention, one of the first case portion and the second case portion is a reservoir which has the inner space, and the other is a cover to open and close the opening portion of the reservoir, and a locating means for engaging with the humidify element is formed in the reservoir.

BEST MODE FOR CARRYING OUT THE INVENTION

The present invention relates to a natural evaporation type humidifier which humidifies air by natural evaporation of water to prevent room air from drying, caused by an air-conditioner etc. for example, a humidify element for boosting humidifying, and a humidifier case for accommodating the humidify element.

The First Embodiment

Figure 1:
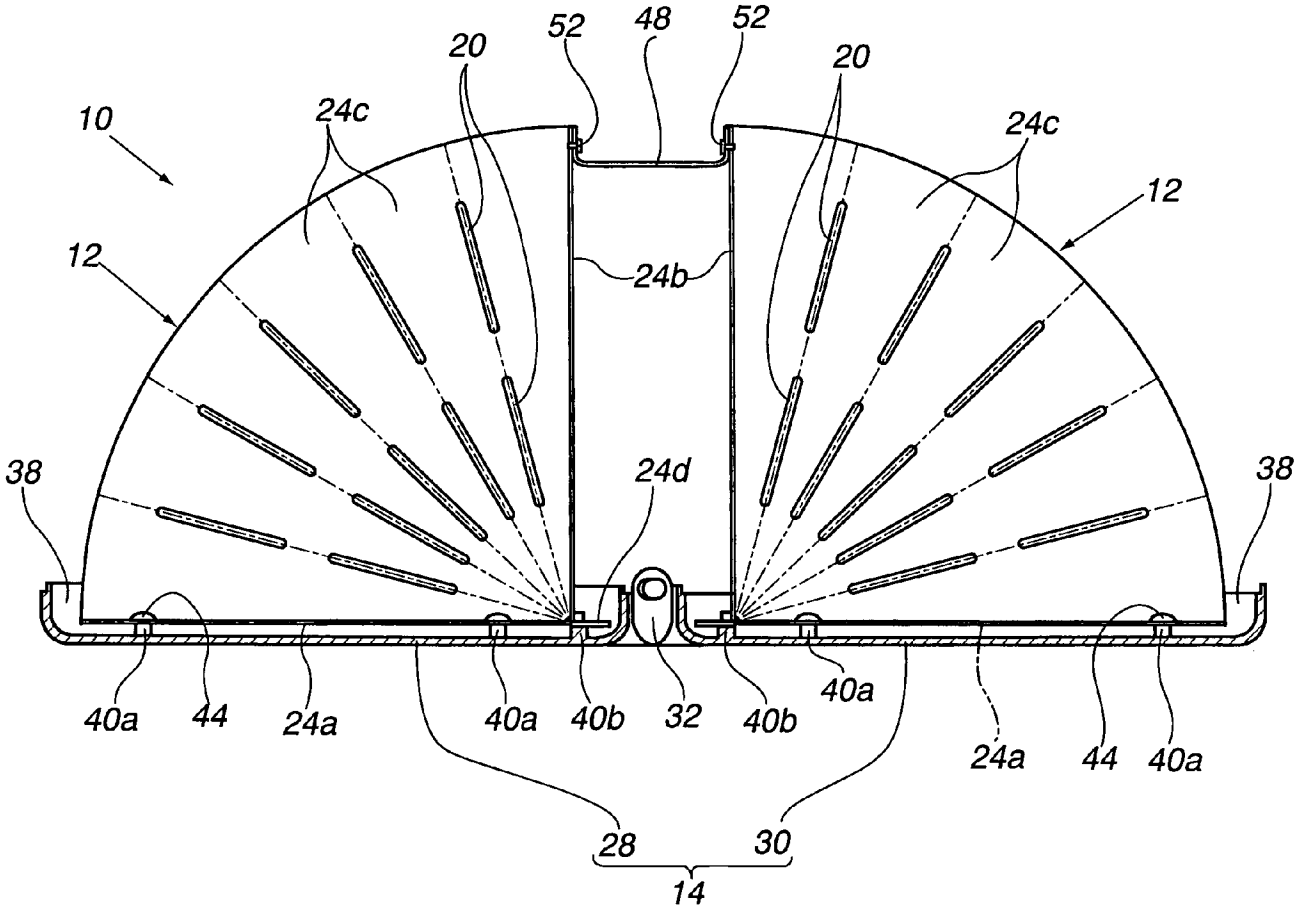
FIG. 1 is a partially sectioned front view showing the usage state of the first embodiment of a natural evaporation type humidifier of the present invention.
Figure 2:
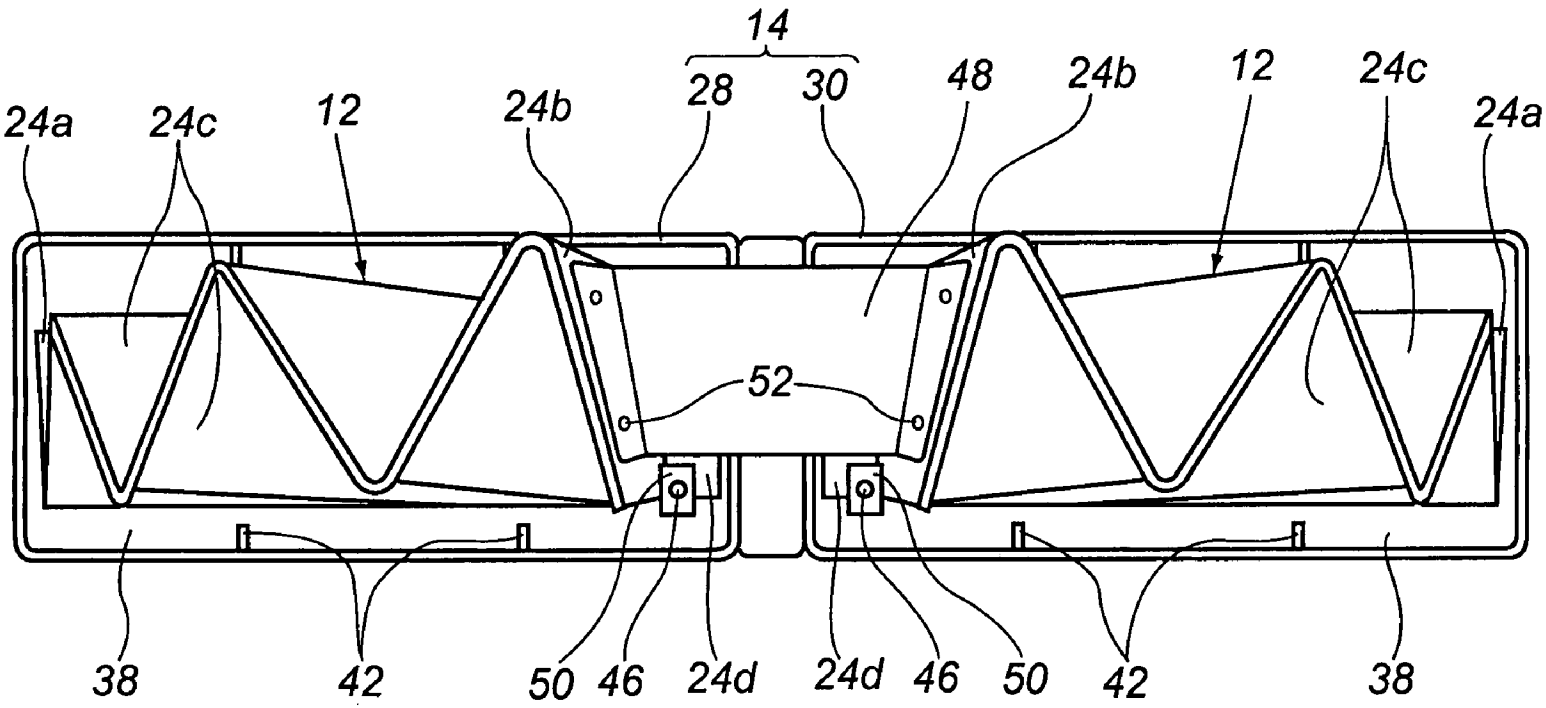
FIG. 2 is a plain view showing the usage state of the natural evaporation type humidifier shown in FIG. 1.
Figure 3:
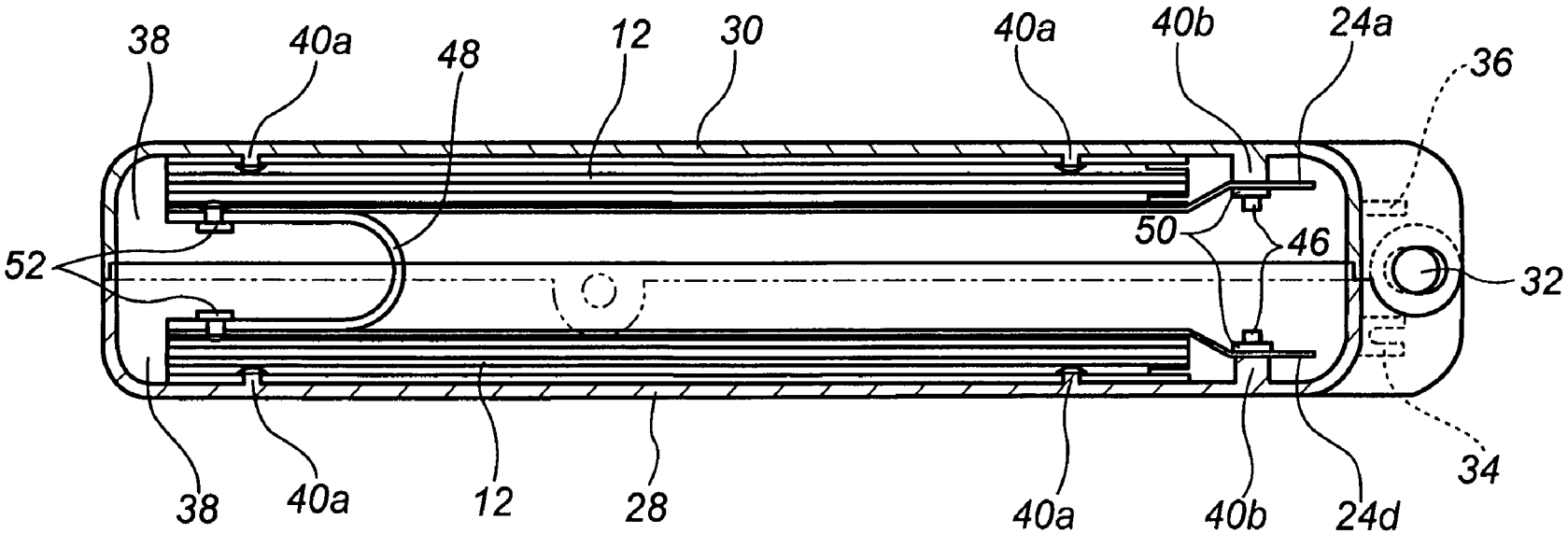
FIG. 3 is a partially sectioned front view showing the non-usage state of the natural evaporation type humidifier shown in FIG. 1.

First, a natural evaporation type humidifier of the present invention is explained based on the drawings. FIG. 1 is a partial sectional view from the front side showing the usage state of a natural evaporation type humidifier of the first embodiment. FIG. 2 is a plain view of the natural evaporation type humidifier shown in FIG. 1. FIG. 3 is a partially sectioned front view showing the non-usage state of the natural evaporation type humidifier shown in FIG. 1. The natural evaporation type humidifier 10 of the first embodiment mainly comprises a humidify element 12 and a case 14.

Figure 4:
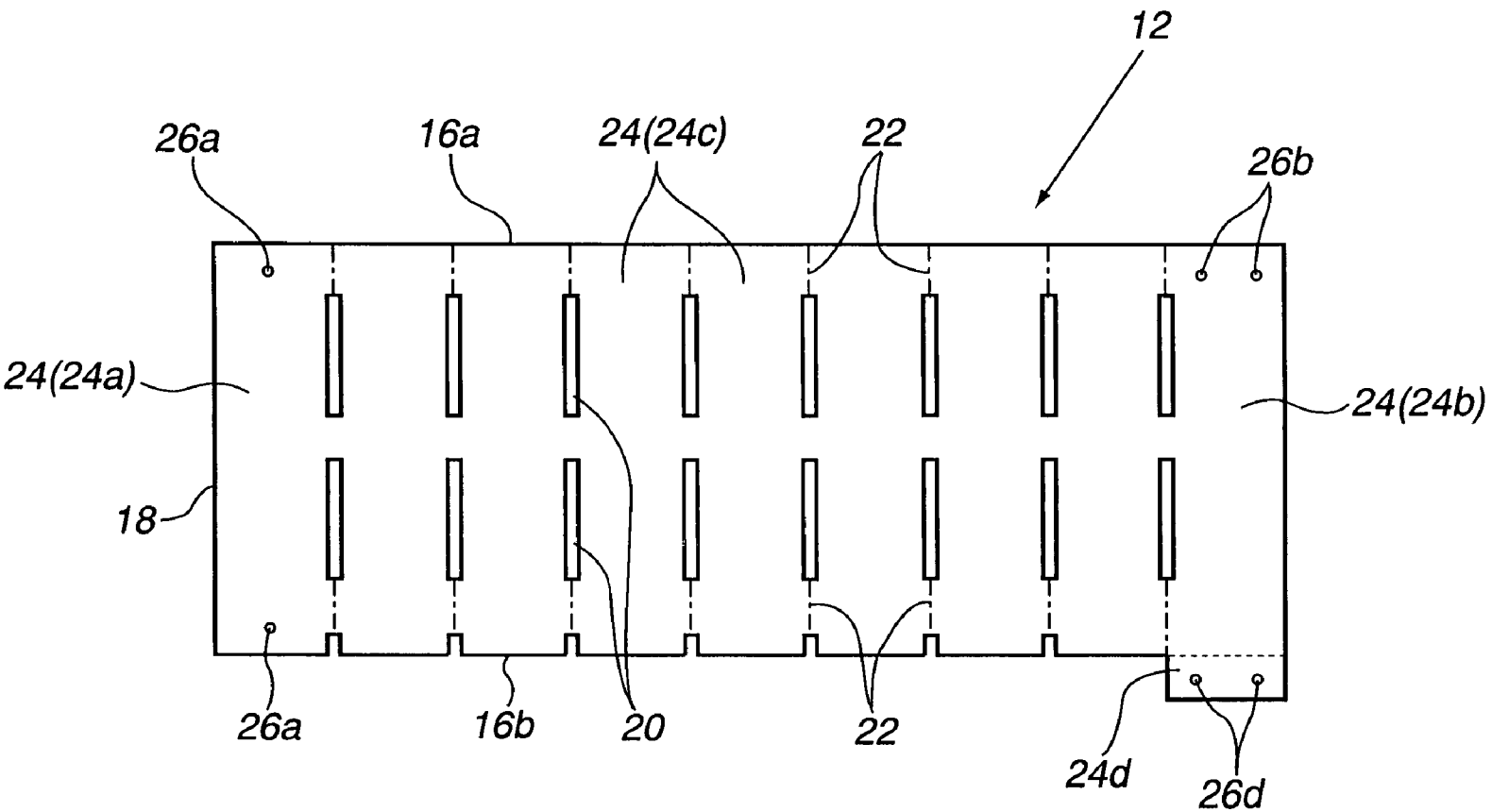
FIG. 4 is a front view showing an example of a humidify element which is utilized for a natural evaporation type humidifier of the present invention.

An example of the humidify element 12 utilized for the natural evaporation type humidifier in FIG. 1 is shown in FIG. 4 as a front view. The humidify element 12 is made of absorptive material, and is constructed as one approximately rectangle-shaped sheet. Slits 20 are formed in parallel with the short side 18 of the rectangle-shaped humidify element 12 within the long side 16*a*, 16*b* at specific intervals. Here, it is possible to form notches instead of slits 20. In the following explanation, the term slit 20 will also include a notch. Instead of being straight, the slit 20 can also be wave-shaped. The humidify element 12 is alternately folded to be a zigzag shape at a plurality of positions where the slits 20 are formed and to be a bellows shape being free to extend and contract. Then, a plurality of humidify segments (humidify regions) 24 are formed by the fold portion 22. The fold portion 22 plays a role as a connecting portion, and connects a plurality of the humidify segments 24. The slit 20 helps the humidify element 12 to be folded easily. In addition, the slit 20 allows air to pass through which boosts evaporation of liquid. In FIG. 4, the number of slits 20 formed at the fold portion 22 is two. However the number of the slits 20 is not limited to two.

The humidify element 12 is formed as a bellows shape which is free to extend and contract by being alternately folded to be a zigzag shape at a plurality of fold portions 22 where the slits 20 are formed. By folding the humidify element 12 to be a zigzag shape at a plurality of positions, the long side 16*a* and the long side 16*b* become folded ridge lines. End humidify segments 24*a*, 24*b* are both end portions of the plurality of humidify segments 24 which are folded to be a bellows shape being free to extend and contract. The plurality of folded portions folded as a bellows shape between the end humidify segment 24*a* and the end humidify segment 24*b* are middle humidify segments 24*c*. One end humidify segment 24*a* is to be attached to a case 14 being free to attach and detach. Holes 26*a* (for example, two holes) are formed at the end humidify segment 24*a* to fit to the case 14. The other end humidify segment 24*b* is connected to a project segment 24*d* which projects to the outer side of the long side. Holes 26*d* (for example, two holes) are formed at the project segment 24*d* to fit to the case 14. The project segment 24*d* is designed so as to be easily folded against the end humidify segment 24*b*. Further, at the vicinity of the end portion of the end humidify segment 24*b* at the opposite side against the connecting position with the project segment 24*d*, holes 26*b* (for example, two hole) are formed to fit to the later-mentioned connect member 48.

As the material for the humidify element 12, it is preferred to adopt absorptive synthetic resin, for example, such as polyester or phenol which is light and resistant to friction. Further, to prevent appearance of various germs or mold at a water-contained condition, it is preferred to mix antibacterial and fungicide with the synthetic resin. To achieve lightening and downsizing, the dimensions of the humidify element 12 used in this embodiment are as follows. The thickness is 0.5 mm and the length of the short side 18 is about 110 mm, for example. When the length of the short side 18 is equal to or less than 50 mm, humidifying capability is insufficient. On the other hand, when the short side 18 is equal to or larger than 150 mm, the sucking capability becomes insufficient and rapid humidifying cannot be performed. Therefore, it is preferred to set the size within this range of 50 mm and 150 mm in accordance with its need. Here, the material of the humidify element 12 is not limited to the abovementioned. Any material which can suck and evaporate water can be adopted for the present invention.

The case 14 is preferred to be made of water repellent material such as synthetic resin, plastic etc. for example. The case 14 is formed by a first case portion 28 and a second case portion 30 which are container-shaped. The first case portion 28 and the second case portion 30 are assembled with a hinge 32 to be free to open and close. Further, the facing surface of each case portion 28, 30 of the hinge 32 side is arranged to maintain the opened state of the case 14. That is, as shown in FIG. 3, a recess portion 34 is formed at the first case portion 28 as a first open retaining engage means, and a project portion 36 which can be engaged with the recess portion 34 is formed at the second case portion 30 as a second open retaining engage means. Further, as shown in FIG. 1, in the condition that the first case portion 28 and the second case portion 30 are spread linearly, the first case portion 28 and the second case portion 30 can mutually be close to and apart from each other in the horizontal direction. Then, the recess portion 34 of the first case portion 28 and the project portion 36 of the second case portion 30 can be engaged and unengaged.

At the first case portion 28 and the second case portion 30, a hollow portion, namely inner space 38, is formed at the position which faces each other when the case 14 is closed. The inner space 38 is a liquid store portion which stores humidifying water or various liquid to moisten the humidify element 12. The volume of the inner space 38 is designed so that the folded humidify element 12 can be stored when the case 14 is closed. The first case portion 28 and the second case portion 30 are preferred to be the same size and the same shape. Thus, when it is closed, the inner space 38 is designed to be sealed by matching each opening portion. When packing etc. (not shown in figures) is disposed at the connecting position between the first case portion 28 and the second case portion 30 to improve air tightness of the inner space 38, the humidifier 10 can be folded and carried without fear of water leaking even when the humidify element 12 contains water.

In this embodiment, one humidify element 12 for each is respectively attached to the first case portion 28 and the second case portion 30, which totals in two humidify elements 12 being used. Since the attachment of the humidify element 12 to the first case portion 28 and the attachment of the humidify element 12 to the second case portion 30 is very similar, only the attachment of the humidify element 12 to the first case portion 28 is explained in the following, and the explanation about the attachment to the second case portion 30 is omitted. The end humidify element 24*a* and the project segment 24*d* of the humidify element 12 are fixed to a wall surface on the inner space 38 side of the first case portion 28. For this purpose, in the first case portion 28, two project portions 40*a* to contact with the end humidify segment 24*a* and one project portion 40*b* to contact with the project segment 24*d* are formed from the wall surface of the inner space 38 side towards the inner space 38, as shown in FIG. 3. A hole (not shown in figures) to match with the hole 26*a* of the end humidify segment 24*a* is formed at the project portion 40*a* from the top end towards the back side. A hole (not shown in figures) to match with the hole 26*d* of the project segment 24*d* is formed at the project portion 40*b* from the top end towards the back side. Here, the holes (not shown in figures) formed at the top ends of the project portion 40*a*, 40*b* are not to pierce the case 14.

In the first case portion 28 and the second case portion 30, fins 42 are formed from the wall surface of the inner space 38 side towards the inner space 38 at specific or appropriate intervals, as shown in FIG. 2. The fins 42 prevent water poured into the inner space 38 of the first case portion 28 and the second case portion 30 from spilling out of the first case portion 28 and the second case portion 30 due to vibration etc. Here, it is also possible to dispose a space similar to the inner space 38 (not shown in figures) outside the case 14 in which some goods other than the humidify element 12 can be stored, such as a toothbrush or a comb etc. which are necessaries for business trips.

The humidify element 12 is fixed to the first case portion 28 at the inner space 38 side being free to attach and detach. Specifically, the end humidify segment 24*a* of the humidify element 12 is contacted to two project portions 40*a* of the first case portion 28. The position of the hole 26*a* of the end humidify segment 24*a* is matched with the position of the hole (not shown in figures) of the project portion 40*a*. An umbrella-shaped pin (a fix means) 44 which head portion is wide is inserted to the hole 26*a* of the end humidify segment 24*a* and the hole (not shown in figures) of the project portion 40*a*. The end humidify segment 24*a* is fixed to the project portion 40*a* with the pin 44, as shown in FIG. 3. In this manner, the end humidify segment 24*a* of the humidify element 12 is fixed to the first case portion 28. Here, the pin 44 is free to attach to and detach from the project portion 40*a*. Further, the project segment 24*d* which is connected to the end humidify segment 24*b* of the humidify element 12 is contacted to the project portion 40*b*. The position of the hole 26*d* of the project segment 24*d* is matched with the position of the hole (not shown in figures) of the project portion 40*b*. An umbrella-shaped pin (a fix means) 46 which head portion is wide is inserted to the hole 26*d* of the project segment 24*d* and the hole (not shown in figures) of the project portion 40*b*. The project segment 24*d* is fixed to the project portion 40*b* with the pin 46, as shown in FIG. 3. Since the long side 16*b* side of the end humidify segment 24*b* is connected to the project segment 24*d*, the long side 16*b* side of the end humidify segment 24*b* is fixed to the first case portion 28. Here, the pin 46 is free to attach to and detach from the project portion 40*b*. In the case that a washer 50 such as silicon rubber etc. is sandwiched between the head portion of the pin 46 and the project segment 24*d* of the humidify element 12 when the project segment 24*d* is fixed to the project portion 40*b*, the fixing force is increased and the pin 46 becomes resistant to loosening even by vibration etc.

In the state that the end humidify segment 24*a* and the project segment 24*d* of the humidify element 12 are fixed to the first case portion 28, one long side 16*b* side of the humidify element 12 which is folded as a bellows shape being free to extend and contract is positioned at almost the hinge of a sector and is arranged not to spread widely. Further, this long side 16*b* side which is the position as the hinge of the sector is disposed at a deep position of the inner space 38. Therefore, when liquid such as water etc. is supplied to the inner space 38, the long side 16*b* side which is at the hinge of the sector is always set to be positioned under the water surface, even when the water evaporates to some extent. On the contrary, the other long side 16*a* side of the humidify element 12 is arranged to be able to open as a sector shape, as described later. Further, any one of the middle humidify segments 24*c* of the humidify element 12 is not fixed to the first case portion 28.

The vicinity of the long side 16*a* side of the end humidify segment 24*b* is not fixed to the first case portion 28. In the same manner, with the humidify element 12 which is attached to the second case portion 30, the vicinity of the long side 16*a* side of the end humidify segment 24*b* is not fixed to the second case portion 30. In order to open and close the two humidify elements 12, a deformable connect member 48 connects the vicinity of the long side 16*a* side of the end humidify segment 24*b* of the humidify element 12 which is attached to the first case portion 28 and the vicinity of the long side 16*a* side of the end humidify segment 24*b* of the humidify element 12 which is attached to the second case portion 30. The following is a specific explanation for both the first case portion 28 and the second case portion 30. A hole (not shown in figures) is formed at the connect member 48, and the hole 26*b* of the end humidify segment 24*b* is matched with the hole of the connect member 48. Pins (fix means) 52 are inserted to these holes to fix the connect member 48 with the vicinity of the long side 16*a* side of the end humidity segment 24*b*. Two humidify elements 12 are connected by the connect means 48. The connect member 48 is made of elastic material, such as silicon rubber etc, and obtains specific strength and deformability. When the humidifier 10 is used, the connect member 48 maintains the shape (for example, a sector shape) as the humidify element 12 is extended. When the humidifier 10 is not used, the connect member 48 is stored with the humidify element 12 in the inner space 38 of the closed case 14.

Next, the method to use the humidifier 10 of the present invention is explained in the following. To use the humidifier 10, the first case portion 28 and the second case portion 30 are opened from a closed state of the case 14 (shown in FIG. 3). The first case portion 28 and the second case portion 30 are extended in the direction of the same line, as shown in FIG. 1. The recess portion 34 of the first case portion 28 and the project portion 36 of the second case portion 30 are fitted together. In this manner, the first case portion 28 and the second case portion 30 are maintained at a fixed state. The connect member 48 connects the long side 16*a* side of the end humidify segment 24*b* of the humidify element 12 which is stored in the inner space 38 of the first case portion 38 and the long side 16*a* side of the end humidify segment 24*b* of the humidify element 12 which is stored in the inner space 38 of the second case portion 30. Therefore, when the case 14 is opened as shown in FIG. 1, the connect member 48 pulls the end humidify segment 24*b* of the humidify element 12 which is attached to the first case portion 28 and the end humidify segment 24*b* of the humidify element 12 which is attached to the second case portion 30. As a result, the two humidify elements 12 deform and form a sector shape.

When setting up the humidifier 10 which cover 14 is opened as shown in FIG. 1 at some appropriate place such as on a desk etc, liquid such as water is supplied to the inner space (the water reservoir portion) 38 of the first case portion 28 and the inner space (the water reservoir portion) 38 of the second case portion 30. Here, the liquid can be tap water or special liquid which contains antiseptic or aromatic etc. The liquid such as water etc. which is supplied to the inner space 38 of the first case portion 28 and the inner space 38 of the second case portion 30 is to be supplied above the long side 16*b* side folded as a zigzag shape of the humidify element 12 which is the hinge position of the sector. With this structure, the whole end humidify segment 24*a*, a part of the end humidify segment 24*b* which is connected to the project segment 24*d*, and a part (the long side 16*b* side) of every middle humidify segment 24*c* is soaked in the water. Therefore, every humidify segment 24*a*, 24*b*, 24*c* is moistened with the water from the soaked position upwards by capillary. When dry room air touches the surface of the humidify element 12 which is moistened with water, moisture evaporates from the moistened humidify element 12 and humidifies the room air. In this embodiment, since one end of every humidify segment 24*a*, 24*b*, 24*c* of the humidify element 12 is soaked in the water, the distance to the top position of each humidify segment 24*a*, 24*b*, 24*c*, which is not moistened, becomes short. Therefore, capillary works effectively and the sucking capability of water is improved, which makes rapid humidifying possible. Here, it can be adapted to the case that the long side 16*b* side of each of the plurality of middle humidify segments 24*c* is not soaked in the water, for example. In this case, the plurality of middle humidify elements 24*c* can be moistened with water from the end humidify elements at both ends.

Since the bellows-shaped humidify element 12 can be folded and stored in the inner space 38 of the first case portion 28 and the inner space 38 of the second case portion 30 when it is not used, the humidifier 10 of this embodiment can be compact as shown in FIG. 3. Therefore, the humidifier 10 can be portable and can be set up at any place. Since the humidify element 12 deforms and spreads in wide width at the time of usage, large surface area for humidifying can be obtained, as shown in FIG. 1 and FIG. 2. Further, the humidifier 10 can be used by only opening the first case portion 28 and the second case portion 30 and engaging the recess portion 34 of the first case portion 28 and the project portion 36 of the second case portion 30. Therefore, it is easy to assemble. By the engaging of the recess portion 34 and the project portion 36, a stable fixed state of the first case portion 28 and the second case portion 30 can be maintained.

With long term usage, there may be a case that the sucking capability of water decreases due to accumulation of lime etc. which are contained in water. Further, there may be a case that the humidify element 12 fades in color, or the humidify element 12 becomes unclean due to propagation of carious germs. In these cases, the humidify element 12 can be removed from the first case portion 28 and the second case portion 30, and replaced easily. Therefore, the humidifier can be used over a long time period. Namely, it is very economical.

Figure 5:
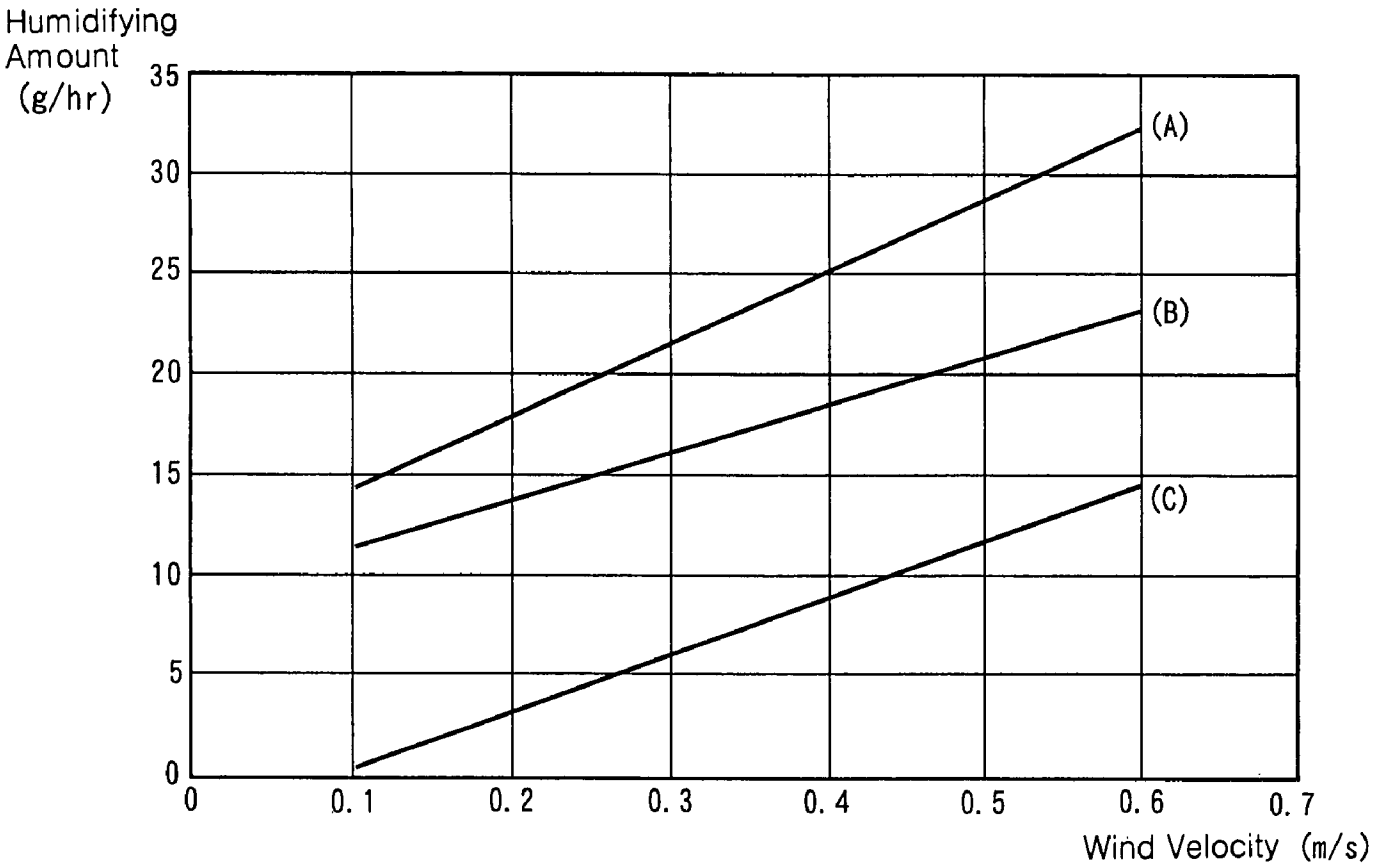
FIG. 5 is a graph showing a comparison of humidifying amount of the humidify elements which are utilized for the present invention.

Further, in the present invention, a plurality of slits 20 are disposed at the humidify element 12. Since water evaporation can be boosted by room air passing through the slits 20, high humidifying capability can be expected. By disposing the slits 20 at the fold portion 22 which is the folded position, it becomes easier for room air to pass through the slits 20, and the humidifying capability can be further improved. Furthermore, when the slits 20 are formed wave-shaped, the area where air passes can be further enlarged. The experimental data of the humidifying amount is shown in FIG. 5, comparing (A) using the humidify element 12 with the slits 20, (B) using the humidify element 12 without the slits 20, and (C) without the humidify element 12 (merely pouring water in the case 14). In this experiment, the humidifying amount is measured by changing the velocity of the wind flowing to the humidify element 12 in the condition that the temperature is 26±1° C. and the humidity is 23.4±2%. Here, the rest of the conditions such as thickness, size, quantity etc. of the humidify element are the same for all (A), (B) and (C).

Comparing the experiment results (A) with (B), (B) with (C), and (A) with (C), as the wind velocity increases, the humidifying amount becomes larger, and the difference becomes larger. For example, when the wind velocity is 0.3 m/sec, the humidifying amounts are (A) about 22 g/h, (B) about 16.5 g/h, and (C) about 4 g/h. Comparing (B) with (C), (B) generates about 4.1 times more humidifying amount than (C). Comparing (A) with (C), (A) generates about 5.5 times more humidifying amount than (C). Consequently, there arises a large difference in humidifying amount between the case with using the humidify element 12 and the case without using the humidify element 12. Further, comparing (A) with (B), (A) generates about 1.33 times more humidifying amount than (B). Consequently, the humidifying capability is higher in the case that the slits 20 are disposed at the humidify element 12 than in the case that the slits 20 are not disposed. Further, when the wind velocity is 0.5 m/sec, the humidifying amounts are (A) about 29 g/h, and (B) about 21 g/h. Comparing (A) with (B), (A) generates about 1.38 times more humidifying amount than (B). Normally, in a room such as an office or a hotel etc, there exists some air flow which velocity range is from 0.3 m/sec to 0.5 m/sec. Therefore, when using the humidifier 10 in normal circumstances, the humidifying capability is increased by about 30% to 40% by disposing the slits 20 to the humidify element 12.

The Second Embodiment

Figure 6:
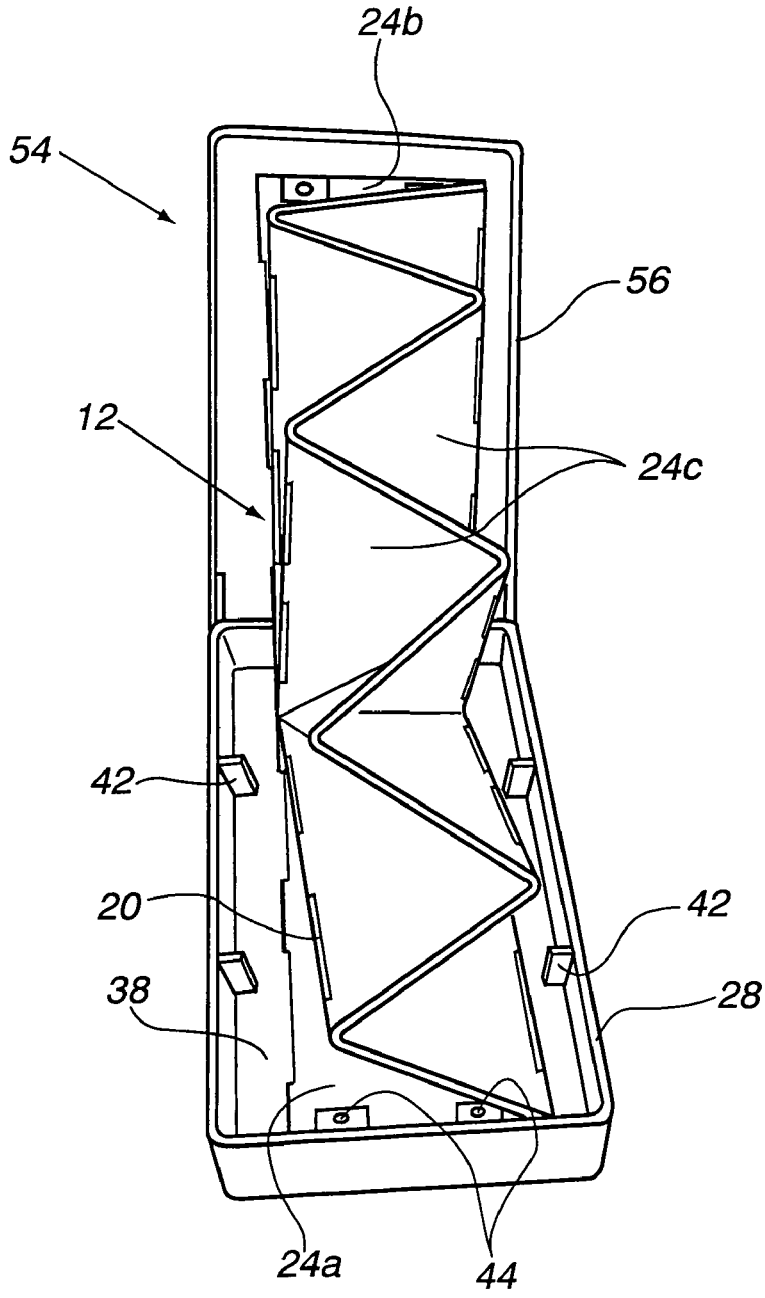
FIG. 6 is a perspective view showing the usage state of another embodiment of a natural evaporation type humidifier of the present invention.

Next, another embodiment of the present invention is explained in the following. FIG. 6 is a perspective view showing the usage state of the second embodiment of a natural evaporation type humidifier of the present invention. In FIG. 6, the same numerical is given to the same member as shown in FIG. 1 through 4. The humidifier 54 of the second embodiment has the first case portion (one case portion) 28 which forms the inner space 38 as the water reservoir portion, and the second case portion (the other case portion) 56 which also serves as a cover attached to the first case portion 28 through a hinge (not shown in figures) being free to open and close. In the humidifier 54 of this embodiment, one humidify element 12 is used. The dimensions and the shape of the humidify element 12 are the same as the one which is used in the first embodiment. One end humidify segment 24*a* of the humidify element 12 is attached to the first case portion 28, and the other end humidify segment 24*b* is attached to the second case portion 56. The attaching method of the end humidify segment 24*b* to the second case portion 56 is the same as that of the first embodiment which is being free to attach and detach. Therefore, the explanation is omitted here. Since one humidify element 12 is used in this embodiment, the humidifier 54 can be more compact and less expensive than that of the first embodiment. Here, it is also possible to use two humidify elements 12 with the connect member 48 as described in the first embodiment.

To use the humidifier 54, the first case portion 28 is opened with the second case portion 56. Then, the humidify element 12 stored in the inner space 38 is pulled in opposite directions by the first case portion 28 and the second case portion 56. As a result, the humidify element 12 deforms and opens as a sector shape. Subsequently, liquid such as water etc. is supplied to the inner space 38 of the first case portion 28. As same as the first embodiment, one end of every humidify segment 24*a*, 24*b*, 24*c* is located at the position of the hinge of the sector shape of the humidify element 12. When water is poured to the inner space 38, one end of the long side 16*b* side of every humidify segment 24*a*, 24*b*, 24*c* is soaked in the water. It is arranged that one end of the long side 16*b* side is sure to be positioned below the water surface, even when the water evaporates to some extent. With this structure, in the humidifier 54 of the second embodiment, as same as the humidifier 10 of the first embodiment, every humidify segment 24*a*, 24*b*, 24*c* is moistened with the water from the soaking position upwards within a short time by capillary. Further, since the humidifier 54 is compact, it can be portable and can be set up anywhere.

The Third Embodiment

Figure 7:
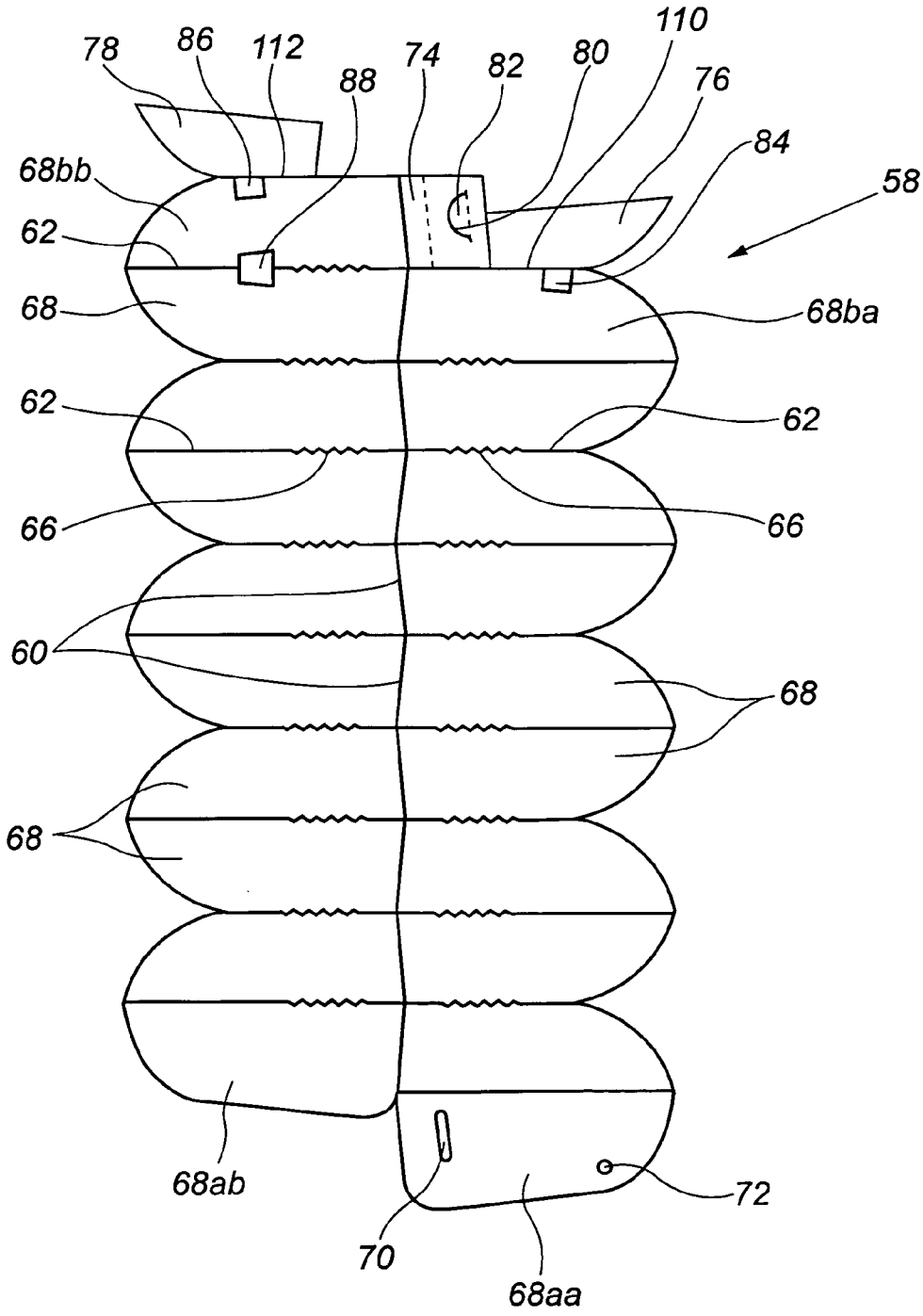
FIG. 7 is a front view showing another example of a humidify element which is utilized for a natural evaporation type humidifier of the present invention.
Figure 8:
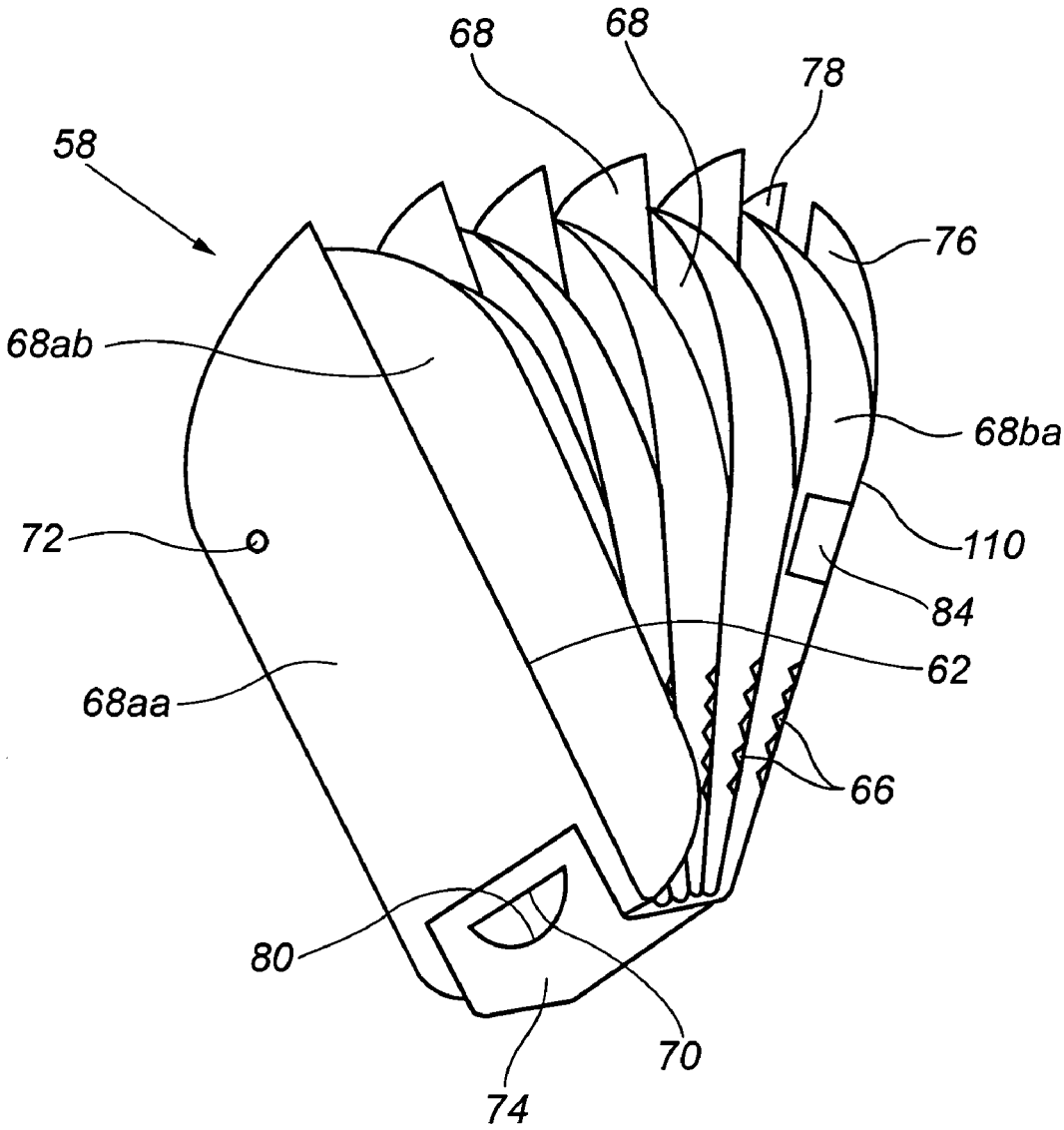
FIG. 8 is a perspective view showing an assembled state by folding the humidify element in FIG. 7.
Figure 9:
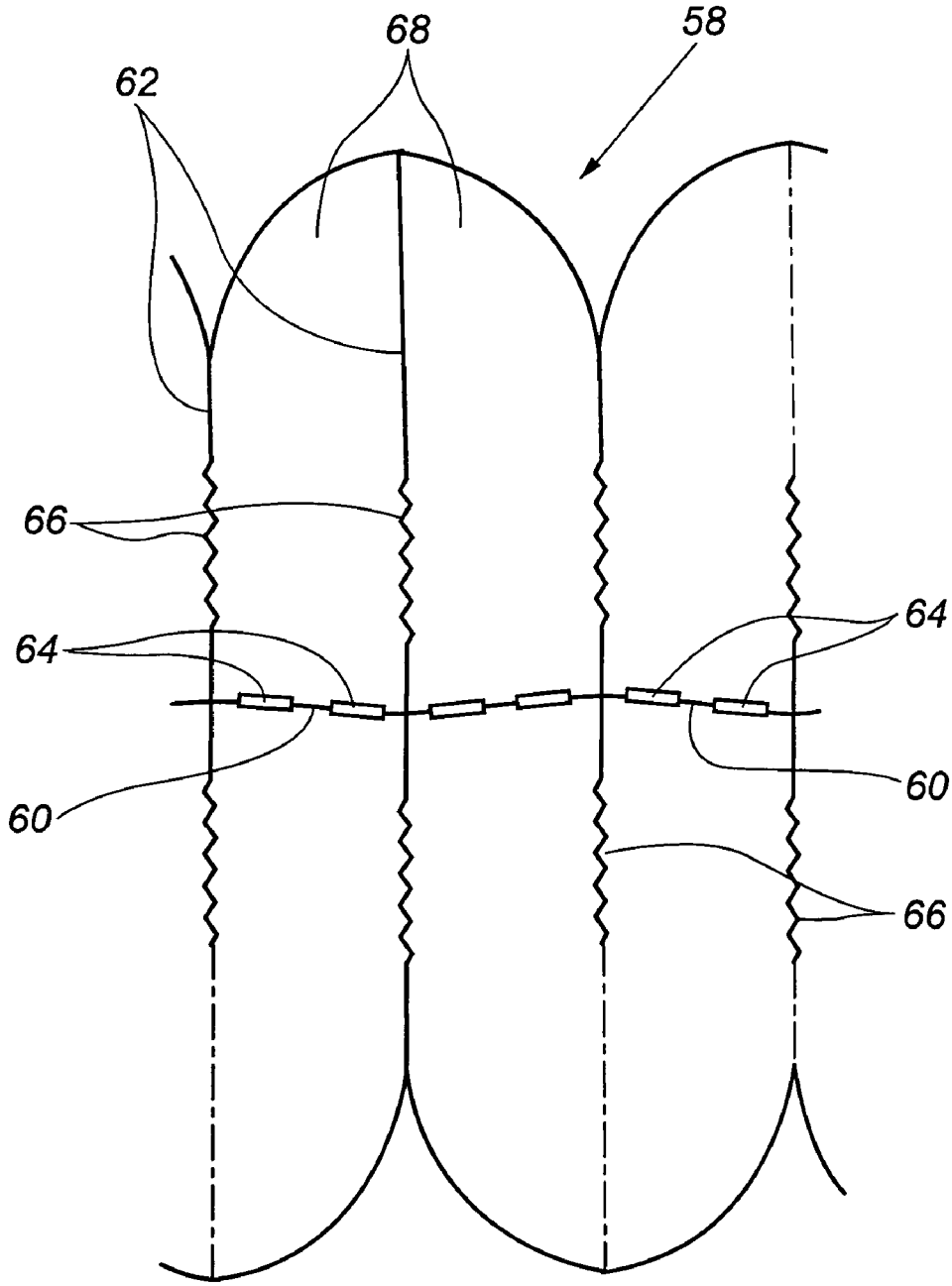
FIG. 9 is an enlarged front view of a main part of the humidify element in FIG. 7.

Next, another embodiment of the humidify element utilized for a natural evaporation type humidifier of the present invention is explained in the following. FIG. 7 is a front view showing another embodiment of the humidify element of the present invention. FIG. 8 is a perspective view showing an assembled state folding the humidify element in FIG. 7. The humidify element 58 is made of absorptive material, and is constructed as one sheet which one side is longer than the other side. The material for the humidify element 58 is the same as that for the humidify element 12 shown in FIG. 4. The humidify element 58 is formed to the state shown in FIG. 8 from the flat state shown in FIG. 7 by repeating folding. A center fold portion 60 is formed so as to fold the humidify element 58 into approximately half along the center in the longitudinal direction, namely, into two. The center fold portion 60 is not linear but curved from side to side several times. In each region of the humidify element 58 divided into two by the center fold portion 60, a plurality of sectional fold portions 62 are formed in a direction approximately perpendicular to the center fold portion 60 at specific intervals. The humidify element 58 is folded along the plurality of sectional fold portions 62 sequentially changing the folding direction. Namely, it is preferred that the folding direction is changed every time the center fold portion 60 crosses the sectional fold portion 62. As shown in FIG. 9, slits 64 are formed along the central fold portion 60. The slits 64 help the sheet to easily be folded into two along the center fold portion 60. Slits 66 are formed along the sectional fold portion 62 at a part of the length of the sectional fold portion 62. The slits 66 make the folding at the sectional fold portion 62 easy, while allowing air pass through the slits 66. The slits 66 can be wave-shaped. When the slits 66 are wave-shaped, more amount of air can pass therethrough. Here, it is possible to form notches instead of slits 66. In the following explanation, the slit 66 will also include a notch. The humidify element 58 is formed by press-cut, for example. At that time, the slits 64, 66 are formed, and the folding of the center fold portion 60 and the sectional fold portions 62 are formed. Further, it is also possible to form dents or grooves in the thickness direction at the positions of the center fold portion 60 and the sectional fold portions 62 of the humidify element 58.

A plurality of humidify segments (humidify regions) 68 are formed by folding the humidify element 58 at the center fold portion 60 and the sectional fold portions 62. The width of the humidify segment 68*aa* and the humidify segment 68*ab* which are divided into two by the center fold portion 60 at one end side of the humidify element 58 is set to be wider than that of the rest of humidify segments 68. A second engage means (an engage slit) 70 and a first locating means 72 to engage with the later-mentioned pin 106 are formed at the humidify segment 68*aa*.

At one side of the position divided into two by the center fold portion 60 at the other end side of the humidify element 58, a connect segment 74 which is separated from the humidify segment 68*ba* formed at the end and a fold-back segment 76 which is connected to the humidify segment 68*ba* are formed. At the other side of the position divided into two by the center fold portion 60 at the other end side of the humidify element 58, a fold-back segment 78 which is connected to the humidify segment 68*bb* formed at the end is formed. Here, the connect segment 74 is connected to the humidify segment 68*bb* via the center fold portion 60. A semicircle-shaped incision 80 is formed at the center of the connect segment 74, for example. A first engage means (an insert segment) 82 is formed by the incision 80. The size and shape of the insert segment 82 are arranged so as to be engaged with the engage slit 70 which is formed at the humidify segment 68*aa*. Here, the first engage means is explained as the insert segment 82 and the second engage means is explained as the engage slit 70. However, it is also possible that the first engage means is an engage slit and the second engage means is an insert segment. At the humidify segment 68*ba* which is connected to the fold-back segment 76, an engage hole 84 is formed at a part of the connecting position with the fold-back segment 76. At the humidify segment 68*bb*, an engage hole 86 is formed at a part of the connecting position with the fold-back segment 78. At the humidify segment 68*bb*, an engage hole 88 is formed so as to straddle both the humidify segment 68*bb* and the humidify segment 68 which is adjacent to the humidify segment 68*bb* at the opposite side to the fold-back segment 78.

The assembling procedure of the humidify element 58 shown in FIG. 7 is explained in the following. Firstly, the humidify element 58 is folded along the center fold portion 60. The folded two regions are lapped together. The lapped portion of the two regions is formed as a bellows shape which is free to extend and contract by being folded in order along the plurality of sectional fold portions 62. Then, the connect segment 74 is folded towards the humidify segment 68*aa* side, and the insert segment 82 of the connect segment 74 is inserted to the engage slit 70 of the humidify segment 68*aa*. In this manner, the assembling is completed, as shown in FIG. 8. In the state that the humidify element 58 is assembled, one end of every humidify segments 68*aa*, 68*ab*, 68*ba*, 68*bb*, and one end of every the humidify segment 68 which are sandwiched thereby are bound up by the connect segment 74. Therefore, when the connect segment 74 is located below the water surface, water can be sucked to one end of every humidify segment 68*aa*, 68*ab*, 68*ba*, 68*bb* and one end of every humidify segment 68. As shown in FIG. 8, by arranging the center fold portion 60 to be a zigzag shape and not to be linear, the segment fold portion 62 can be arranged in alternate order. Then, the plurality of segment fold portions 62 which face the same direction can be properly aligned in two lines. Further, the sectional fold portions 62 of the humidify element 58 which has some thickness can easily be folded to be parallel. When the center fold portion 60 is arranged to be linear and not to be a zigzag shape, the sectional fold portions 62 which face the same direction cannot be properly aligned. Further, the sectional fold portions 62 of the humidify element 58 which has some thickness cannot be folded easily.

Figure 10:
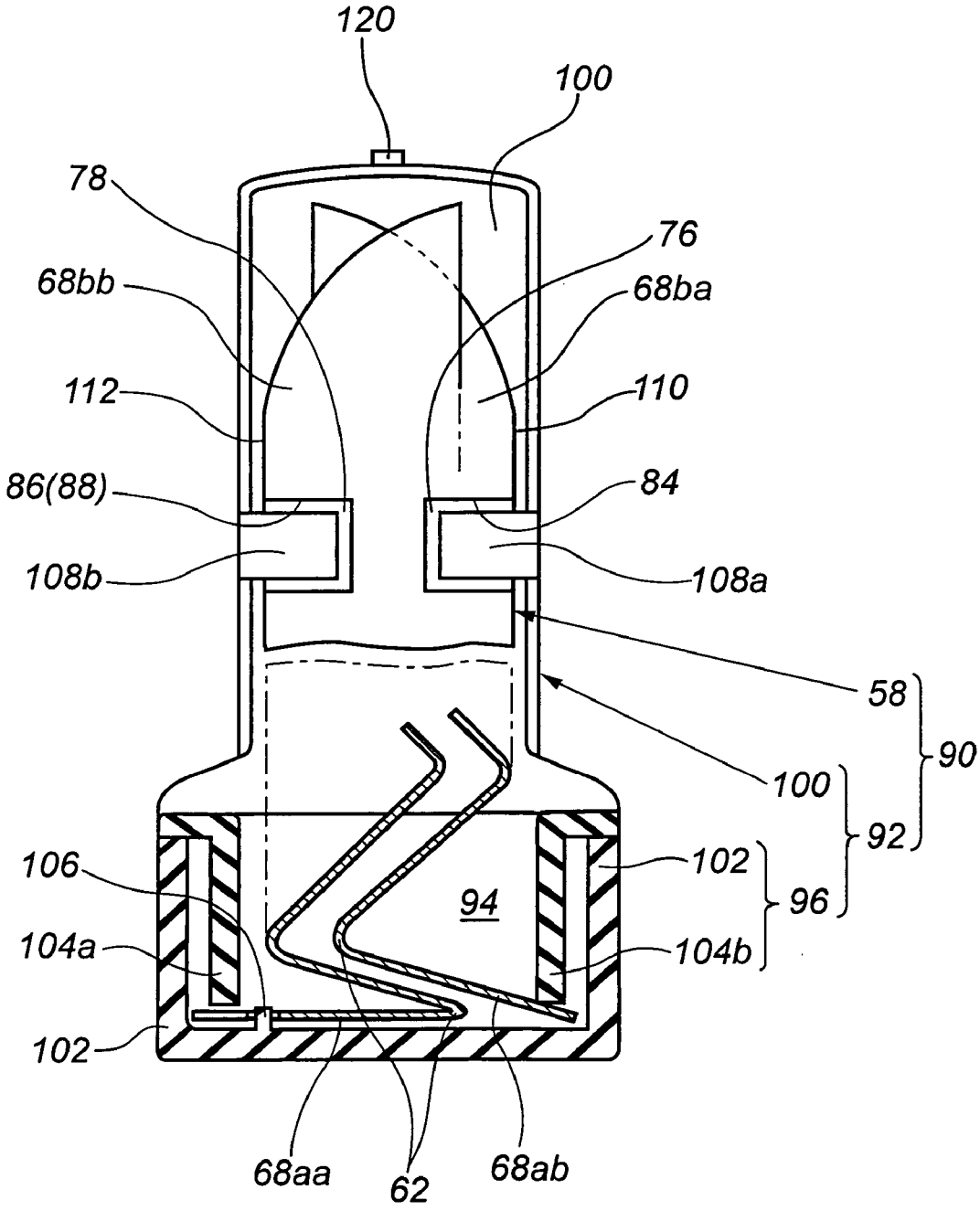
FIG. 10 is a schematic explanatory drawing showing a state that the humidify element in FIG. 8 is attached to a case and a cover.
Figure 11:
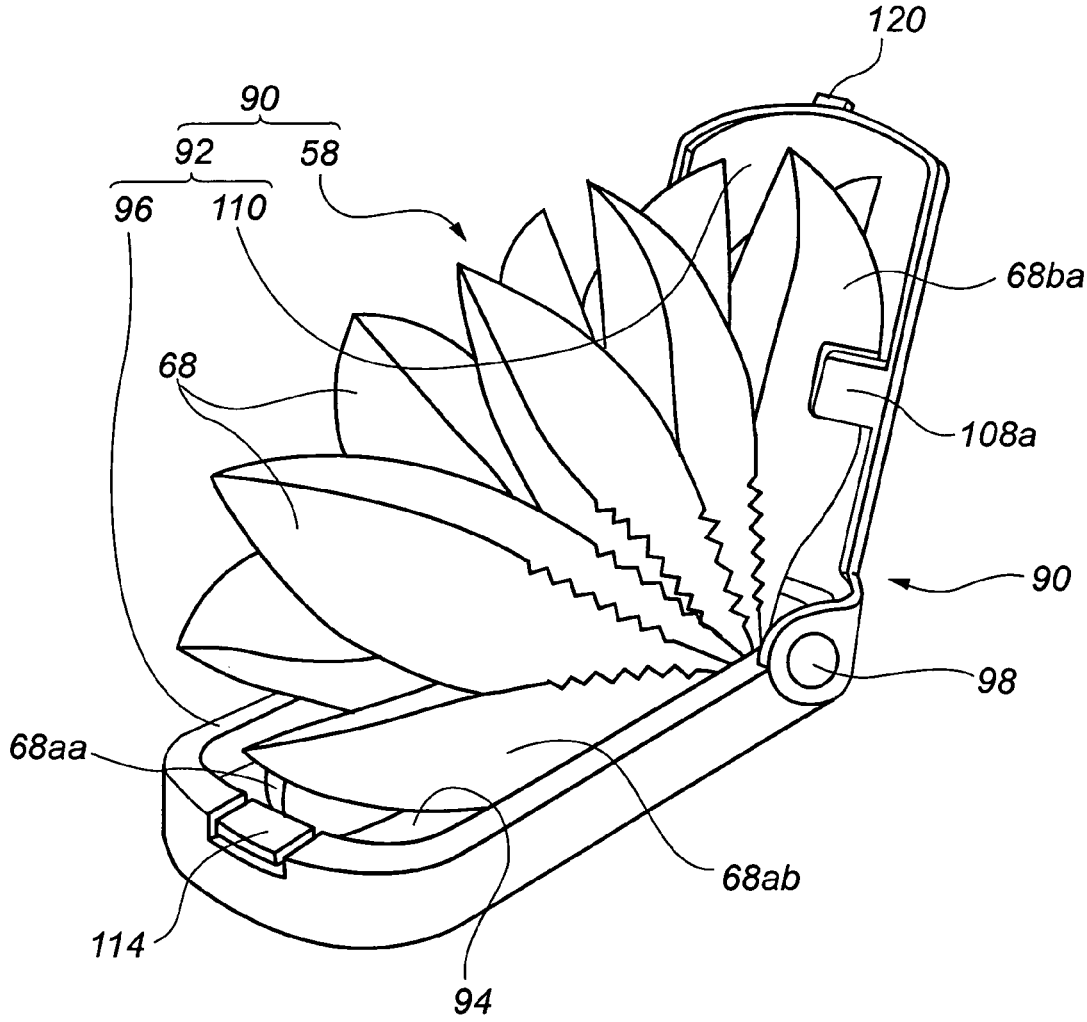
FIG. 11 is a perspective view showing a usage state of a natural evaporation type humidifier utilizing the humidify element in FIG. 8.

The natural evaporation type humidifier 90 of the third embodiment comprises the humidify element 58 which is assembled as shown in FIG. 8, and the case 92 as shown in FIG. 10 and FIG. 11. The case 92 has a reservoir 96 as the first case portion (one case portion) which forms the inner space 94 for a water reservoir, and a cover 100 as the second case portion (the other case portion) which is attached to the reservoir 96 via a hinge 98 to be free to open and close. A project portion 104 which projects to the inner space 94 side from the base portion 102 and a base portion 102 are fixed by fitting, adhesion etc, so as to form the case 96. In FIG. 10, the project potion 104 is expressed as 104*a*, 104*b* for explanation. Some gap is formed between the bottom end of the project portion 104*a*, 104*b* and the bottom surface of the base portion 102. The project portion 104 works as a retain means to retain the humidify element 58 in the case 96. However, the retain means to retain the humidify element 58 in the case 96 is not limited to the project portion 104. At the bottom surface of the base portion 102, a pin 106 is formed as a second locating means which projects towards the inner space 94. Here, the following is the procedure to attach one end of the humidify element 58 to the case 96. As shown in FIG. 10, the circumference of the humidify segment 68*aa* (the circumference at the opposite side of the sectional fold portion 62) is inserted to the gap between the bottom end of one project portion 104*a* and the bottom surface of the case 96. Then, a hole 72 of the humidify segment 68*aa* is engaged with the pin 106 of the case 96. Further, the circumference of the humidify segment 68*ab* (the circumference at the opposite side of the sectional fold portion 62) is inserted to the gap between the bottom end of the other project portion 104*b* and the bottom surface of the case 96. In this manner, one end of the humidify element 58 can be attached to the case 96. On the contrary, one end of the humidify element 58 can be detached easily from the case 96 by the following procedure. First, the hole 72 of the humidify segment 68*aa* is disconnected from the pin 106. Then, the humidify segment 68*aa* is detached from the gap between the bottom end of one project portion 104*a* and the bottom surface of the case 96. Finally, the humidify segment 68*ab* is detached from the gap between the bottom end of the other project portion 104*b* and the bottom surface of the case 96.

Here, it is also possible to attach one end of the humidify element 58 to the case 96 in a fixed manner with a long and slim plate (not shown in figures) by the following procedure. First, the humidify segment 68*aa* and the humidify segment 68*ab* are pressed down from the upper side with a flexible long and slim plate (not shown in figures). The long and slim plate is passed through the slit 66 shown in FIG. 7. Then, both ends of the long and slim plate are respectively inserted to the gaps between the bottom end of the bilateral project portions 104*a*, 104*b* and the bottom surface of the case 96.

As shown in FIG. 10 and FIG. 11, bilateral retain arms 108*a*, 108*b* are integrally formed at the cover 100. A gap to which one through three humidify segments can be inserted is formed between the bilateral retain arms 108*a*, 108*b* and the inner surface of the cover 100. In order to attach the other end of the humidify element 58 to the cover 100, the sectional fold portion 110 (shown in FIG. 8 and FIG. 10) side between the humidify segment 68*ba* and the fold-back segment 78 is inserted to the gap between the retain arm 108*a* and the cover 100, and the engage hole 84 which is formed at the humidify segment 68*a* is engaged with the retain arm 108*a*. In this way, the fold-back segment 76 which is connected with the humidify segment 68*ba* can be attached to the cover 100. The sectional fold portion 112 (shown in FIG. 10) side between the humidify segment 68*bb* and the fold-back segment 78 is inserted to the gap between the other retain arm 108*b* and the cover 100, and the engage hole 86 and the engage hole 88 which are formed at the humidify segment 68*bb* etc. are engaged with the retain arm 108*b*. In this way, the fold-back segment 78 which is connected with the humidify segment 68*bb* can be attached to the cover 100. Consequently, the other end of the humidify element 58 can be attached to the cover 100 without coming off. Further, by detaching the humidify segments engaging with retain arms from the retain arm 108*a* and the retain arm 108*b*, the other end of the humidify element 58 can be easily detached from the cover 100. Here, in the state that one end of the humidify element 58 is attached to the reservoir 96 and the other end of the humidify element 58 is attached to the cover 100, the size and the shape of the humidify element 58 is arranged so that the connect segment 74 which positions at the hinge of the sector shape of the humidify element 58 is located at the lower side of the inner space 94 of the reservoir 96.

FIG. 11 shows a state that the humidify element 58 is attached to the reservoir 96 and the cover 100. When the humidifier 90 is used, the cover 100 is opened against the reservoir 96. With this motion, both ends of the humidify element 58 stored in the inner space 94 are pulled in opposite directions by the reservoir 96 and the cover 100. Then, the humidify element 58 deforms and opens as a sector shape. Namely, in the humidify element 58, the humidify segments 68 which are connected via the sectional fold portions 62 are displaced by external force with the sectional hold portions 62 as the boundaries. At the time of assembling, the humidify element 58 is folded along the center fold portion 60, and two regions are lapped together. Then, a bellows shape which is free to extend and contract is formed by folding along the plurality of sectional fold segments 62. Therefore, at the time of usage as shown in FIG. 11, the humidify segments 68 of the humidify element 58 consisting of two regions are arranged in two lines and change positions alternately as in flower petals. Namely, every humidify segment 68 is respectively at a separated state. Therefore, evaporation of moisture from each humidify segment 68 can be boosted.

Further, since the connect segment 74 (shown in FIG. 8) which positions at the hinge of the sector shape of the humidify element 58 is located at the bottom of the inner space 94 of the reservoir 96, when liquid such as water etc. is supplied to the inner space 94 of the reservoir 96, one end of every humidify segment 68*aa*, 68*ab*, 68*ba*, 68*bb* and one end of every humidify segment 68 are soaked in water. Then, one end of every humidify segments 68*aa*, 68*ab*, 68, 68*ba*, 68*bb* is sure to be positioned below the water surface, even when the water in the reservoir 96 evaporates to some extent. With this structure, every humidify segment 68*aa*, 68*ab*, 68, 68*ba*, 68*bb* is moistened with the water from the soaking position upwards within a short time by capillary. Further, since the humidifier 90 is compact, it can be portable and can be set up anywhere.

Figure 12:
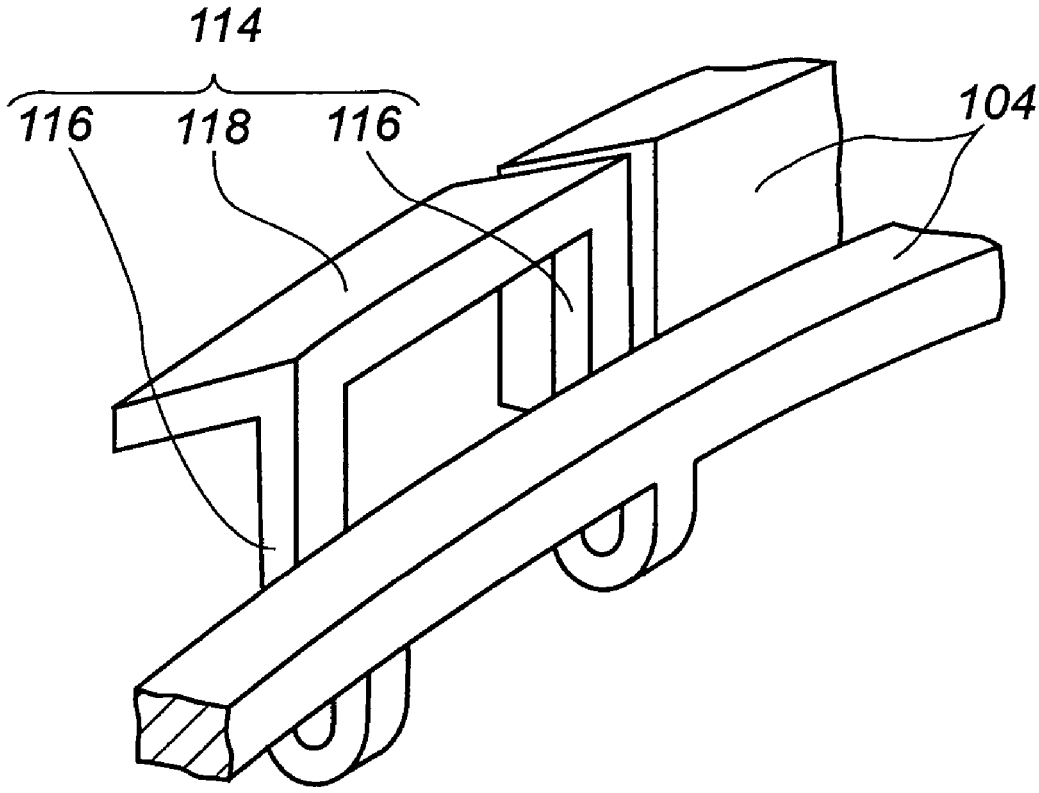
FIG. 12 is a perspective view of a main part of the case shown in FIG. 11.
Figure 13:
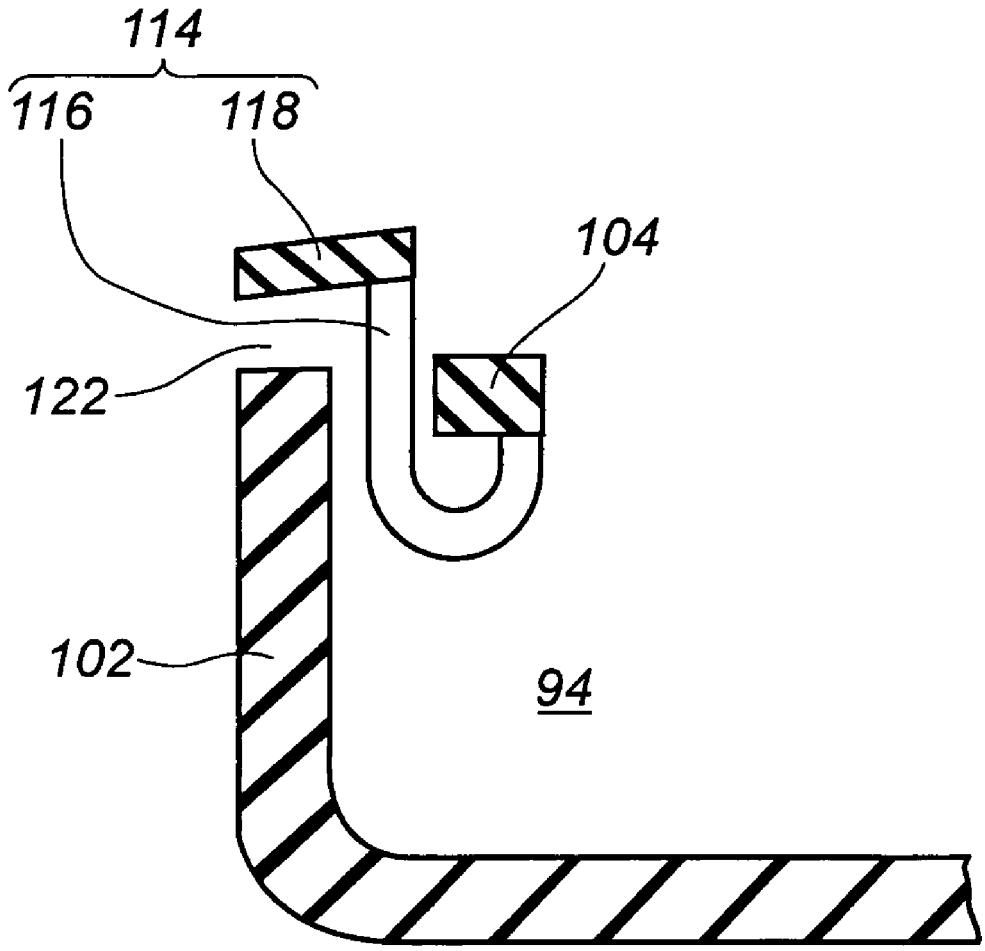
FIG. 13 is a sectional view of a main part of the case shown in FIG. 11.

As shown in FIG. 11, FIG. 12 and FIG. 13, a first closure retaining engage means 114 is disposed at the reservoir 96. As shown in FIG. 12, the first closure retaining engage means 114 comprises two arm portions 116 which are connected to the project portion 104, and a plate-shaped portion 118 which is connected to the two arm portions 116. When there is force to push the plate-shaped portion 118 from the upper side towards the lower side, the arm portions 116 deform and the plate-shaped portion 118 is arranged so as to move towards the outer side of the reservoir 96. As shown in FIG. 10 and FIG. 11, a projection 120 as a second closure retaining engage means is integrally formed at the center of the free end of the cover 100 to be engaged with the first closure retaining engage means 114.

Figure 14:
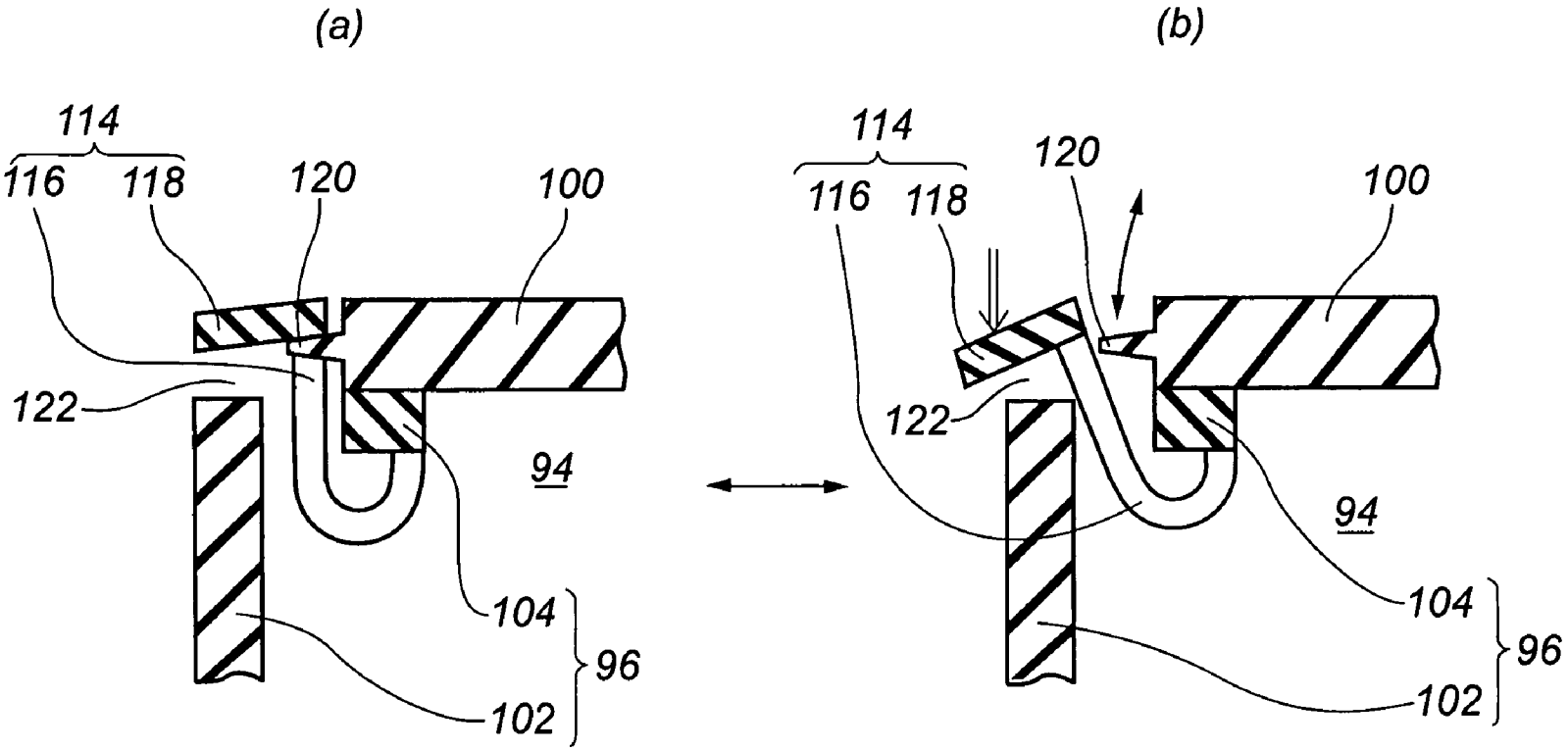
FIG. 14 is a sectional view showing the open-close states of the case in FIG. 11.

The opening and closing of the cover 100 are explained in the following with reference to FIG. 14. FIG. 14(*a*) shows a state that the cover 100 is closed. In the state that the cover 100 is closed, the cover 100 contacts the upper surface of the project portion 104. Further, the upper surface (the upper surface in FIG. 14(*a*)) of the projection 120 of the cover 100 contacts the lower surface (the lower surface in FIG. 14(*a*)) of the plate-shaped portion 118. In order to open the cover 100 from this state, force to push the plate-shaped portion 118 downwards is applied as shown in FIG. 14(*b*). Then, the plate-shaped portion 118 moves to the outer side of the reservoir 96, and the plate-shaped portion 118 no longer exists above the projection 120. In this manner, the cover 100 can be opened. On the contrary, in order to close the cover 100, the cover 100 is contacted to the upper surface of the project portion 104 while applying force to push the plate-shaped portion 118 downwards as shown in FIG. 14(*b*). Then, when the force pushing the plate-shaped portion 118 downwards is eliminated, the plate-shaped portion 118 returns to the original position, and moves above the projection 120, as shown in FIG. 14(*b*). With this procedure, the plate-shaped portion 118 prevents the projection 120 from moving upwards, and opening of the cover 100 can be prevented. Here, even in the case that the cover 100 is closed quickly, the projection 120 at the top end of the cover 100 temporary moves the plate-shaped portion 118 to the outer side of the reservoir 96. Then, the plate-shaped portion 118 automatically returns to the original position, and the projection 120 positions below the plate-shaped portion 118. In this manner, the cover 100 is closed.

Here, in the case 92, it is possible to adopt the following structure to maintain the positions of the reservoir 96 and the cover 100 at an opened state. A first open retaining engage means which is similar to the one in the first embodiment is disposed at the reservoir 96, and a second open retaining engage means which is similar to the first embodiment is disposed at the cover 100. Then, the first open retaining engage means and the second open retaining engage means are engaged.

As shown in FIG. 13 and FIG. 14, a gap 122 is formed between the lower surface of the plate-shaped portion 118 and the upper end of the base portion 102 (the reservoir 96). The gap 122 is arranged so that the inner space 94 of the reservoir 96 is always connected with the outside. With this arrangement, in the state that liquid is stored in the inner space 94 of the reservoir 96 and the cover 100 is closed, the liquid stored in the inner space 94 can be discharged through the gap 122 by inclining the natural evaporation type humidifier 90. In this manner, the discharge of liquid can be performed without wetting the hands.

The Fourth Embodiment

Figure 15:
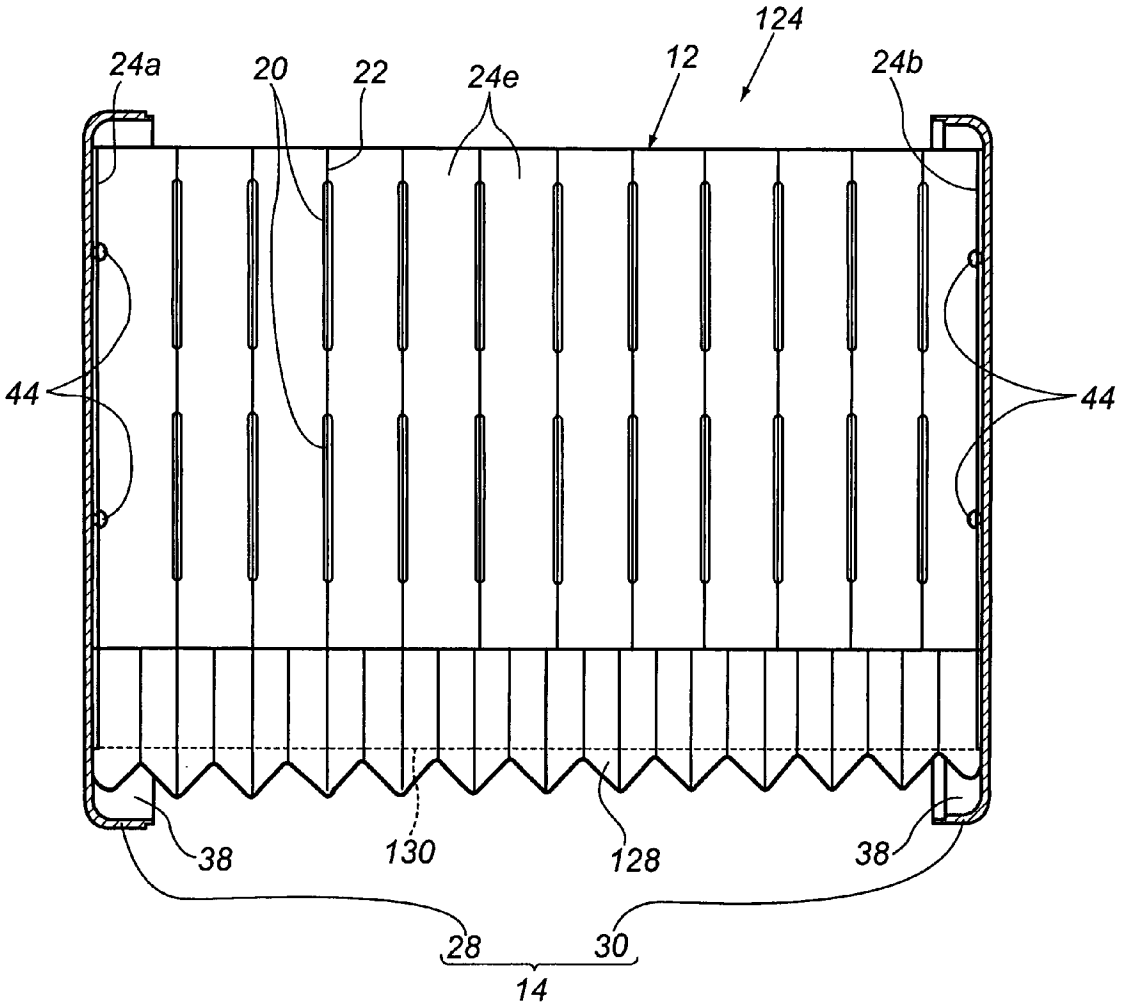
FIG. 15 is a partially sectioned front view showing the usage state of another embodiment of a natural evaporation type humidifier of the present invention.
Figure 16:
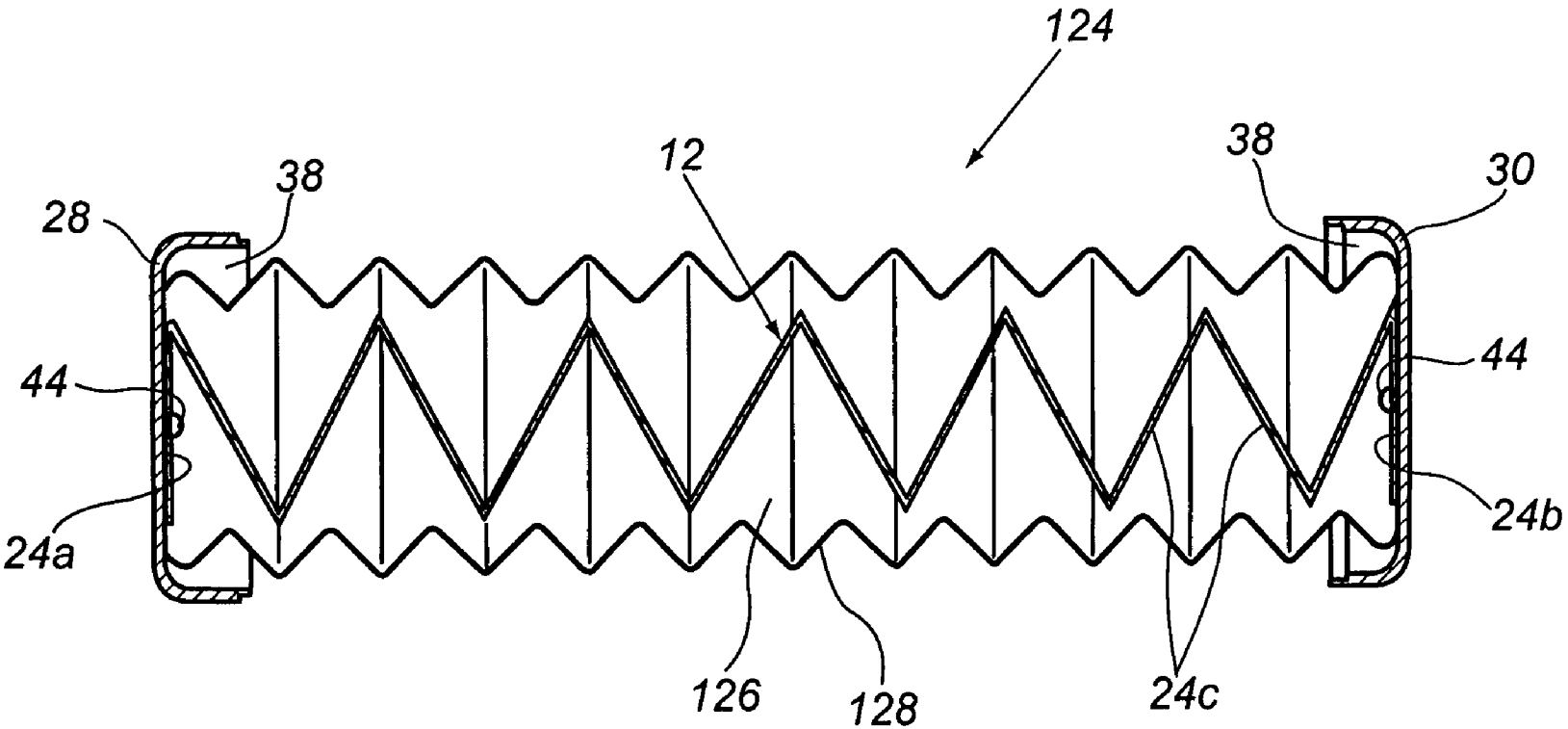
FIG. 16 is a sectional view in the horizontal direction of FIG. 15.

Further, another embodiment of the present invention is explained in the following. FIG. 15 is a partially sectioned front view showing the fourth embodiment of a natural evaporation type humidifier of the present invention. FIG. 16 is a partially sectioned plain view of FIG. 15. FIG. 15 and FIG. 16 show the state of usage. Here, in FIG. 15 and FIG. 16, the same numerical is given to the same member as shown in FIG. 1 though 4. The natural evaporation type humidifier 124 of the fourth embodiment mainly comprises a humidify element 12 which is a bellows shape being free to extend and contract, a case 14 which is formed by a first case portion 28 and a second case portion 30, and a water receive portion 128 which is a bellows shape being free to extend and contract with a water reservoir 126 inside. The first case portion 28 and the second case portion 30 are arranged so that they can be attached and detached to open and close. The water receive portion 128 is preferred to be made of synthetic resin which is water-repellant, such as plastic etc.

One end humidify segment 24*a* of the humidify element 12 is fixed by a pin (a fix means) 44 being free to attach to and detach from the inner wall which defines the inner space 38 of the first case portion 28. Then, the other end humidify segment 24*b* is fixed by a pin (a fix means) 44 being free to attach to and detach from the inner wall which defines the inner space 38 of the second case portion 30. One end of the water receive portion 128 which is free to extend and contract is fixed by a fix means (not shown in figures) being free to attach to and detach from the inner wall which defines the inner space 38 of the first case portion 28. The other end is fixed by a fix means (not shown in figures) being free to attach to and detach from the inner wall which defines the inner space 38 of the second case portion 30. In this embodiment, the water reservoir 126 is formed at the water receive portion 128, and the humidify element 12 and the water receive portion 128 are stored in the inner space 38.

In a state that the first case portion 28 and the second case portion 30 are joined (namely, the case 14 is closed), the folded humidify element 12 and the folded water receive portion 128 are arranged to be stored in the inner space 38 of the first case portion 28 and the inner space 38 of the second case portion 30. Further, in a case that the first case portion 28 and the second case portion 30 are joined (namely, the case 14 is closed), or are separated (namely, the case 14 is opened), every bottom end rim 130 (shown by the dotted line in FIG. 15) of all the humidify segments 24*a*, 24*b*, 24*c* of the humidify element 12 is arranged to be located at a lower position in the water reservoir 126 of the water receive portion 128. Although the bottom end rim 130 of the humidify element 12 and the bottom face of the water receive portion 128 are not contacted in FIG. 15, it is also possible to be contacted or fixed.

The humidifier 124 of the abovementioned structure is used with the following procedure. The first case portion 28 and the second case portion 30 are pulled in a direction to be apart from each other and displaced. The humidify element 12 and the water receive portion 128 which are stored in the inner space 38 of the case 14 are extended in the same horizontal direction. The humidifier 124 is disposed so that the humidify element 12 positions at the upper side and the water receive portion 128 positions at the lower side. Then, the first case portion 28 and the second case portion 30 are set on a desk etc, and water is supplied to the water reservoir portion 126 of the water receive portion 128. Since every bottom end of all the humidify segments 24*a*, 24*b*, 24*c* of the humidify element 12 is soaked in the water of the water reservoir portion 126, the portions of all the humidify segments 24*a*, 24*b*, 24*c* above the water surface are moistened with the water in a short time by capillary. Consequently, room air is humidified when air touches the humidify element 12 above the water surface. In this embodiment, since both the humidify element 12 and the water receive portion 128 are free to extend and contract in the same direction, the separated distance between the first case portion 28 and the second case portion 30, namely, the opening angle, can be freely adjusted. Therefore, the humidifying amount can be adjusted.

The Fifth Embodiment

Figure 17:
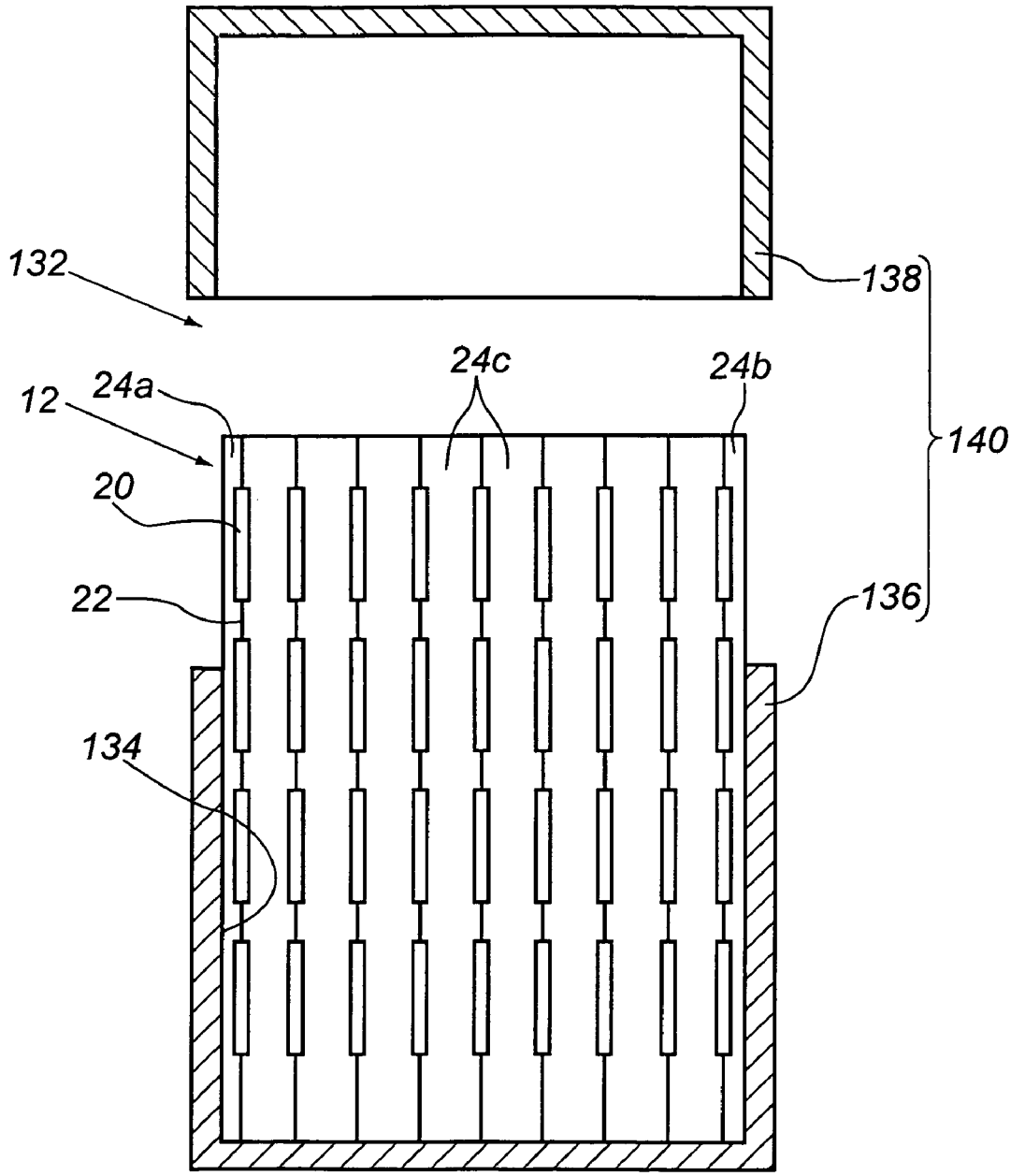
FIG. 17 is a partial sectional view showing another embodiment of a natural evaporation type humidifier of the present invention.
Figure 18:
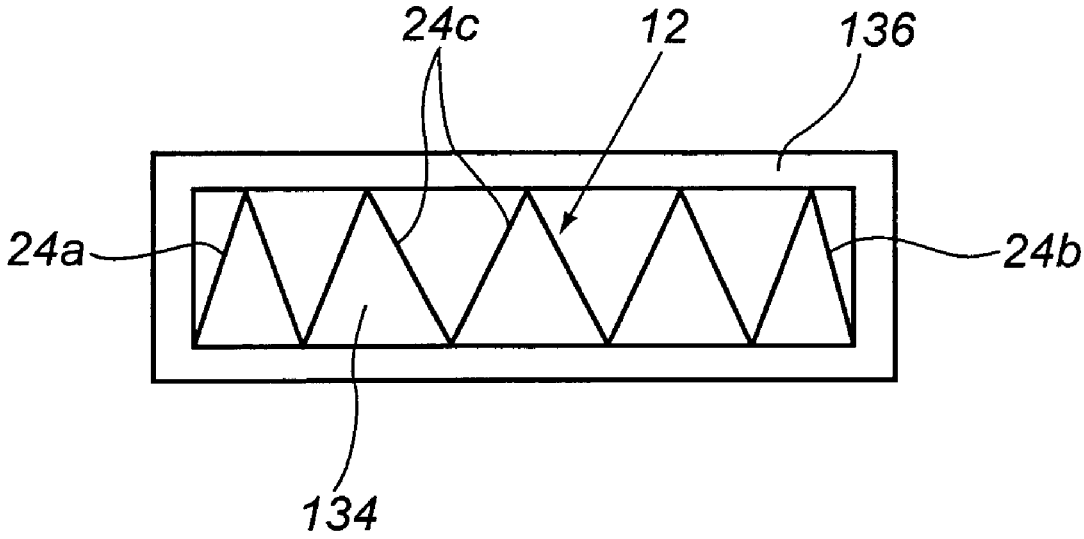
FIG. 18 is a plain view in the state that the cover is eliminated from the natural evaporation type humidifier shown in FIG. 17.

Further, another embodiment of the present invention is explained in the following. FIG. 17 is a partial sectional view showing the fifth embodiment of a natural evaporation type humidifier of the present invention. FIG. 18 is a plain view of FIG. 17. Here, in FIG. 17, the same numeral is given to the same member in FIG. 4. The humidifier 132 of the fifth embodiment comprises a reservoir 136 as the first case portion which forms the inner space 134 as the water reservoir, an open-close cover 138 as the second case portion, and a humidify element 12. The case 140 is structured by the reservoir 136 and the cover 138. The cover 138 can be structured to be attached to the reservoir 136 by a hinge etc, or be possible of being separated from the reservoir 136. The humidify element 12 shown in FIG. 4 is inserted to the inner space 134 of the reservoir 136 in a state being bellows-shaped which is free to extend and contract by folding at the positions of the slits 20. At that time, when the bellows-shaped humidify element 12 is mounted to the inner space 134 with both sides compressed, the humidify element 12 will not come off from the reservoir because extension force generated by the humidify element 12 pushes the inner wall of the reservoir 136. Therefore, there is no need to fix the humidify element 12 to the reservoir 136 by a fix means such as a pin etc. The humidifier 132 is used by opening the cover 138, and supplying water to the inner space 134 of the reservoir 136 to soak a part of every humidify segment 24*a*, 24*b*, 24*c* of the humidify element 12. With this procedure, all the humidify segments 24*a*, 24*b*, 24*c* can be moistened in a short time by capillary from the soaked portion in the water to the upper portion which is not soaked in the water.

The Sixth Embodiment

Figure 19:
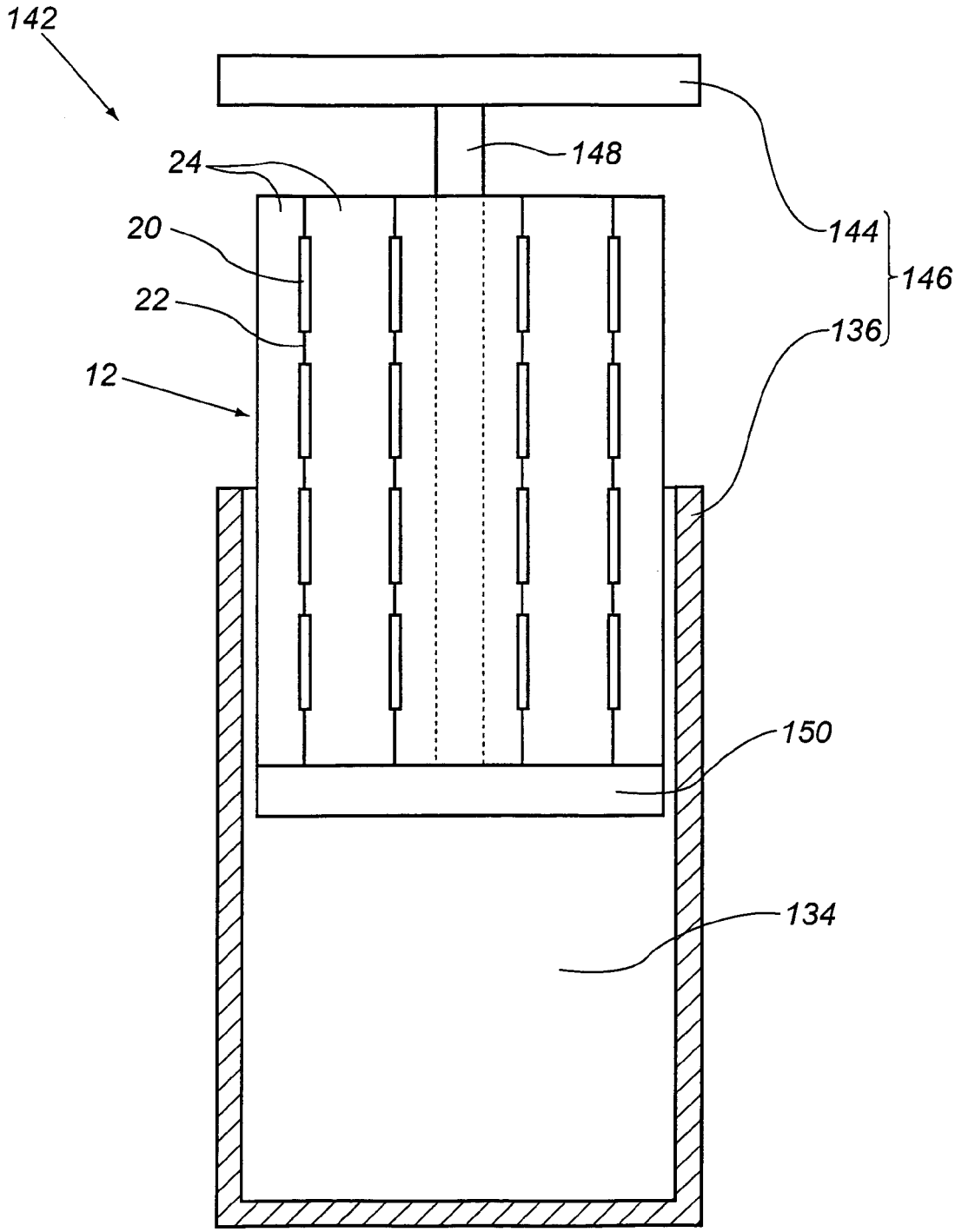
FIG. 19 is a partial sectional view showing another embodiment of a natural evaporation type humidifier of the present invention.

Further, another embodiment of the present invention is explained in the following. FIG. 19 is a partial sectional view showing the sixth embodiment of a natural evaporation type humidifier of the present invention. Here, in FIG. 19, the same numeral is given to the same member in FIG. 4 and FIG. 17. The humidifier 142 comprises a reservoir 136 as the first case portion which forms the inner space 134 as the water reservoir, and an open-close cover 144 as the second case portion. The case 146 is structured by the reservoir 136 and the cover 144. Further, the humidifier 142 comprises a shaft 148 which is fixed to the cover 144, a support plate 150 which is fixed to the shaft 148 at the opposite side of the cover 144, and a humidify element 12 which is disposed so as to surround the shaft 148 while being on the support plate 150. The humidify element 12 surrounds the shaft once while one end humidify segment is contacted and fixed to the other end humidify segment. When the humidifier 142 is not used, the support plate 150 is inserted to the inner space 134 as the top, and the opening of the reservoir 136 is closed by the cover 144. Here, it is preferred that the reservoir 136 is cylindrical, and the support plate 150 and the cover 144 are disk-shaped.

When the humidifier 142 is used, by moving the cover 144 above the opening of the reservoir 136, the humidify element 12 moves, and the upper portion of the humidify element 12 is exposed above the reservoir 136. That is, by opening the cover 144, the humidify element 12 can be moved to a position so that the upper portion touches air. Then, water is supplied to the inner space 134 of the reservoir 136 so that the bottom portion of the humidify element 12 is sufficiently soaked. With this procedure, all the humidify elements 24 are moistened upwards from the water surface in a short time by capillary. Consequently, by touching the humidify element 12 which is exposed from the reservoir 136, room air is humidified.

The Seventh Embodiment

Figure 20:
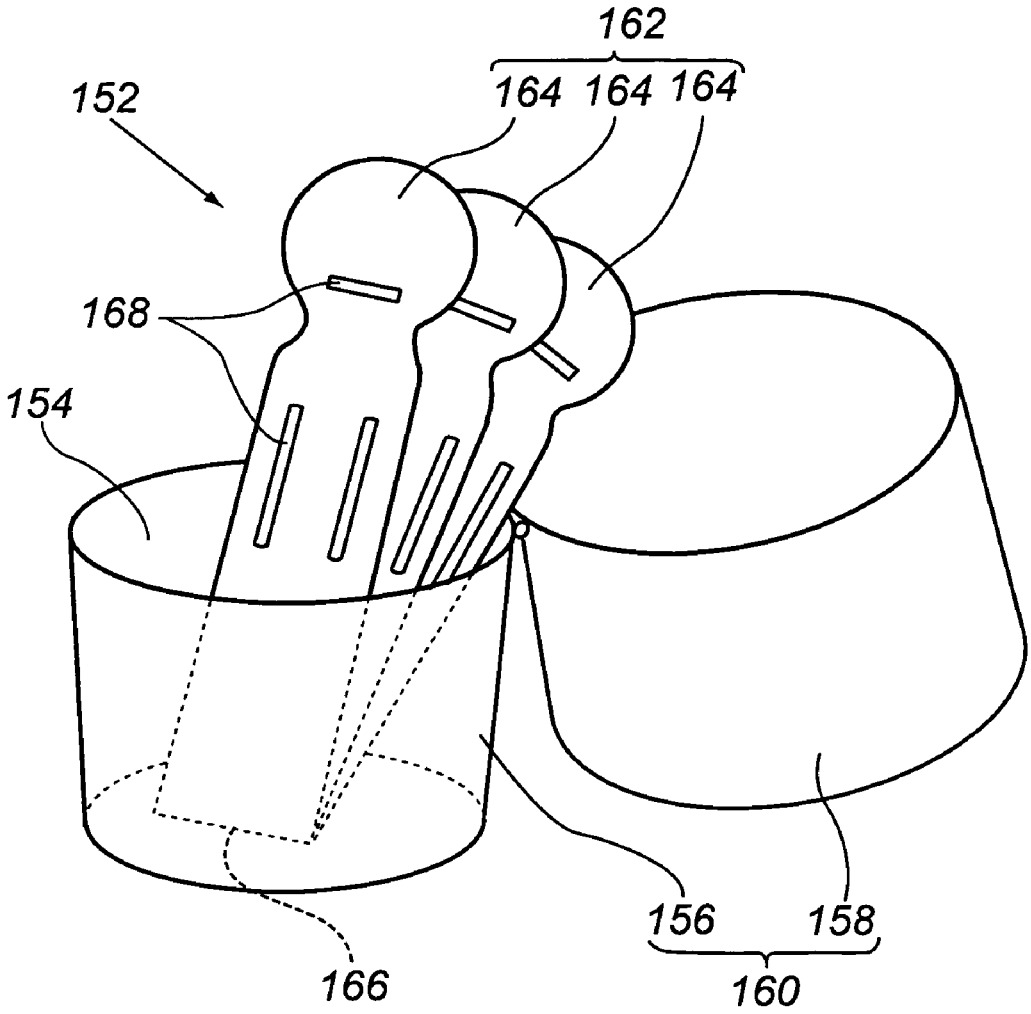
FIG. 20 is a perspective view showing another embodiment of a natural evaporation type humidifier of the present invention.

Further, another embodiment of the present invention is explained in the following. FIG. 20 is a perspective view of a natural evaporation type humidifier of the seventh embodiment of the present invention. The humidifier 152 of this embodiment comprises a case 160 which consists of a reservoir 156 as the first case portion having the water reservoir 154 inside and a cover 158 as the second case portion, and a humidify element 162 which is inserted to the water reservoir 154. The humidify element 162 is formed by connecting one end portion of all the plurality of humidify segments 164 with a connect portion 166. For example, in the humidify element 162 shown in FIG. 20, every humidify segment 164 has the same shape. Then, the bottom portions (the connect portions 166) of all the humidify segments 164 are connected by adhesion or folding etc. Further, by forming slits 168 or notches (not shown in figures) or tinting to each humidify segment 164, specific characters can be designed. When the slit 168 is formed as a wave shape, more air can flow through.

In the humidify segment 162 shown in FIG. 20, the plurality of humidify segments 164 are connected at one position of the connect portion 166. However, instead of this structure, it is possible to connect the top end portion and the bottom end portion of each humidify segment 164 sequentially to be a bellows shape. At the time of usage, water is supplied to the water reservoir 154 of the reservoir 156, and the humidify element 162 is inserted to the water reservoir 154 of the reservoir 156 while one end of every bellows-shaped humidify segment 164 being as the top. Consequently, the bottom side of all the humidify segments 164 is soaked in the water, and the upper portion of all the humidify segments 164 can be moistened in a short time by capillary. Room air is humidified with water evaporation from the portions of the moistened humidify element 162 touching air.

The Eighth Embodiment

Figure 21:
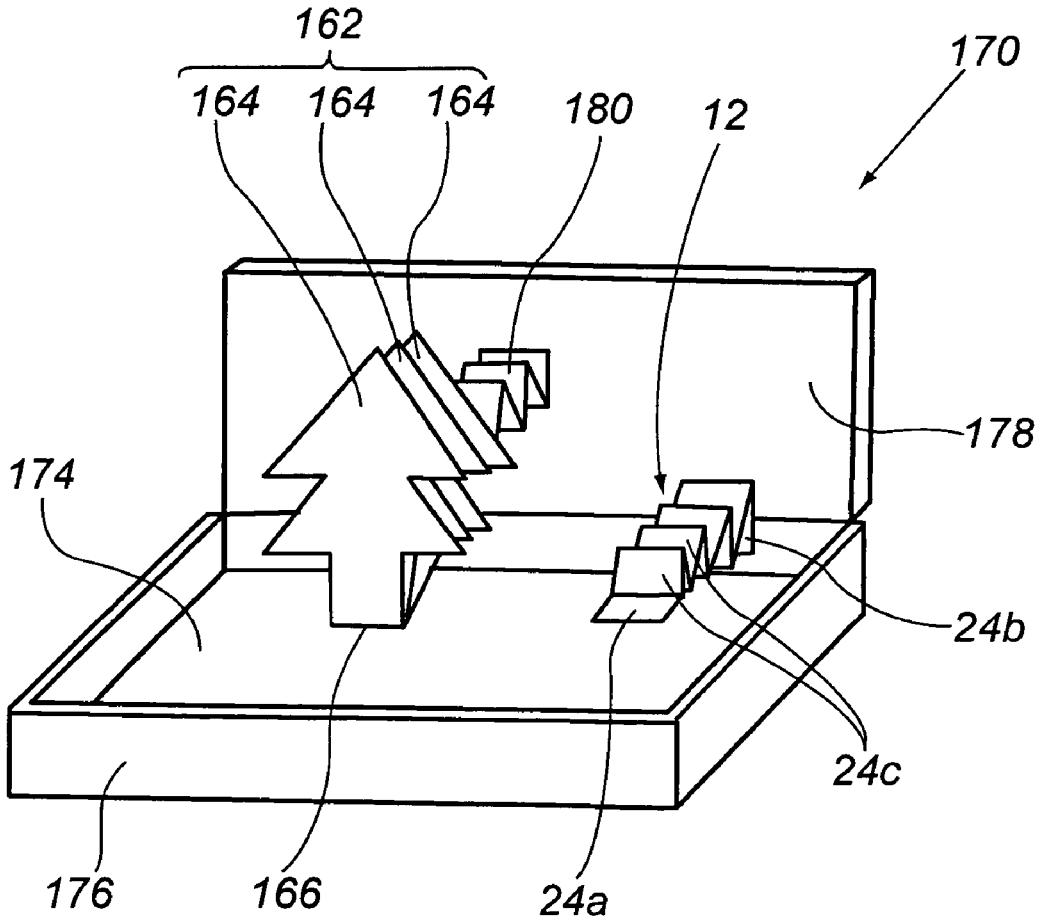
FIG. 21 is a perspective view showing another embodiment of a natural evaporation type humidifier of the present invention.

Further, another embodiment of the present invention is explained in the following. FIG. 21 is a perspective view showing the eighth embodiment of a natural evaporation type humidifier of the present invention. Here, in FIG. 21, the same numeral is given to the same member in FIG. 4 and FIG. 20. The humidifier 170 of this embodiment comprises the humidify element 12 (shown in FIG. 4) having the plurality of humidify segments 24*a*, 24*b*, 24*c* as a bellows shape being free to extend and contract, the humidify element 162 in FIG. 20 (shown in a different shape) which has the plurality of humidify segments 164 connected at each one end by the connect portion 166, the reservoir 176 as one case portion having the inner space 174 as the water reservoir portion, and the cover 178 as the other case portion. One end of the end humidify segment 24*a* of the bellows-shaped humidify element 12 is fixed to the bottom surface at the inner space 174 side of the reservoir 176 being free to attach and detach. The other end of the end humidify segment 24*b* is fixed to both the reservoir 176 and the cover 178. By closing the reservoir 176 with the cover 178, the bellows-shaped humidify element 12 is contracted and stored in the inner space 174 of the reservoir 176. It is preferred that one end of every humidify segment 24*a*, 24*b*, 24*c* of the bellows-shaped humidify element 12 is located at the lower side of the inner space 174. The connect portion 166 of every humidify segment 164 of the humidify element 162 is fixed to the bottom surface at the inner space 174 side of the reservoir 176 being free to extend and contract. The humidify segments 164 which is located near the cover 178 is fixed to the cover 178 being free to attach and detach with a bellows-shaped connect member 180 which is free to extend and contract. By closing the reservoir 176 with the cover 178, the humidify element 162 and the connect member 180 are folded and stored in the inner space 174 of the reservoir 176.

With this embodiment, at the time of usage, the cover 178 is opened, and water is supplied to the inner space 174 of the reservoir 176. Since the bottom end portions of all the humidify segments 24*a*, 24*b*, 24*c* of the bellows-shaped humidify element 12 are soaked in the water, all the humidify segments 24*a*, 24*b*, 24*c* are moistened in a short time. With the humidify element 162, since the bottom end portion of the humidify segment 164 including the connect portion 166 is soaked in the water, all the humidify segments 164 are moistened in a short time. Room air is humidified with water evaporation from the touching position of air with the moistened humidify elements 12, 164. In this embodiment, when the humidifier is used, the humidify elements 12, 162 which are formed as arbitrary design rise with the cover 178. Therefore, it is possible to provide a three-dimensional and visually amusing humidifier. Here, in this embodiment, two kinds of humidify elements, which is the humidify element 12 and the humidify element 162, are utilized. However, it is also possible to use only one kind.

The Ninth Embodiment

Figure 22:
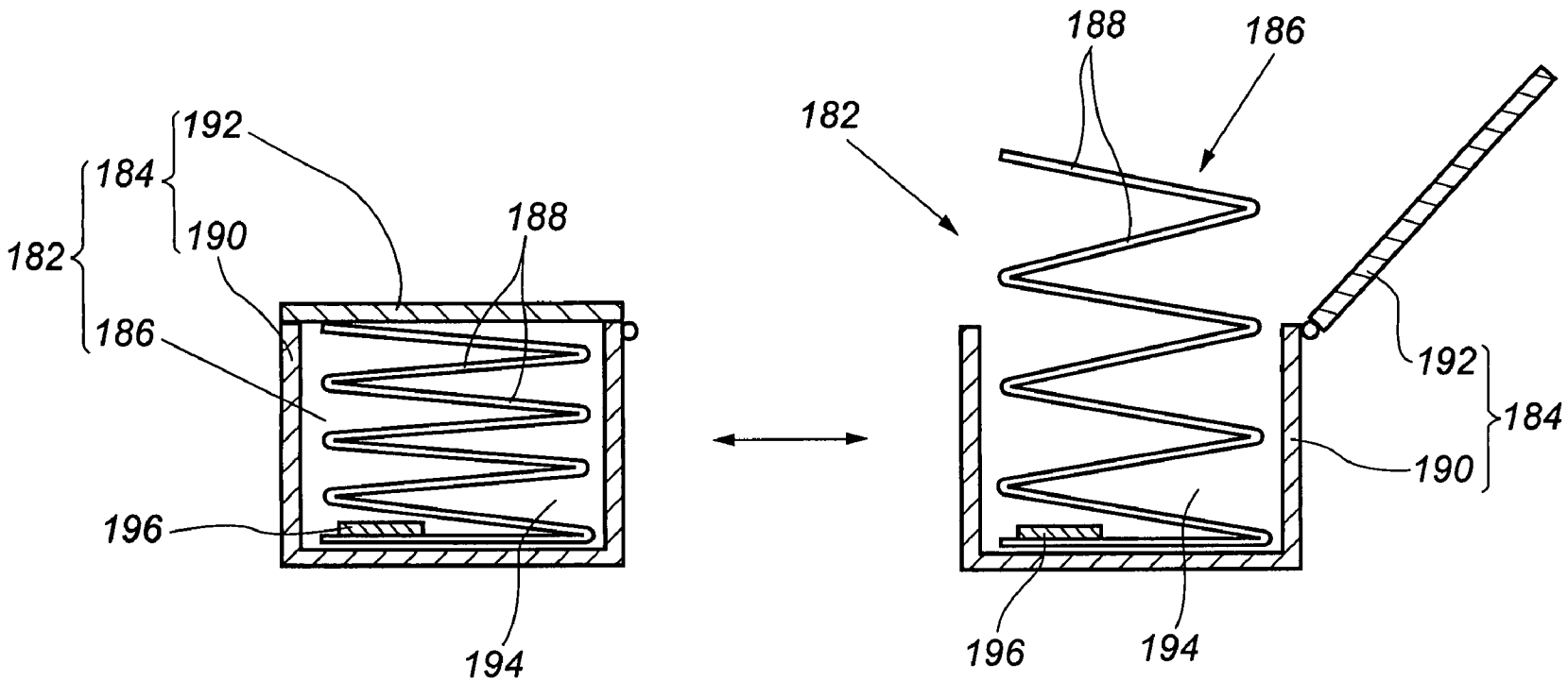
FIG. 22 is a sectional view showing another embodiment of a natural evaporation type humidifier of the present invention.

Further, another embodiment of the present invention is explained in the following. FIG. 22 is a sectional view showing a natural evaporation type humidifier of the ninth embodiment of the present invention. The natural evaporation type humidifier 182 of the ninth embodiment comprises a case 184, and a humidify element 186 which is accommodated in the case 184. For example, the humidify element 186 is formed by folding one sheet-shaped material to be a plurality of humidify segments 188 as a bellows shape being free to extend and contract. The case 184 consists of a reservoir 190 as a first case portion, and a cover 192 as the second case portion. An inner space 194 is formed in the reservoir 190. The humidify element 186 is disposed in the inner space 194. A retain arm 196 is disposed at the vicinity of the bottom portion of the reservoir 190 to retain the humidify element 186. One end portion of the humidify element 186 is fixed to the reservoir 190 being free to attach and detach by the retain arm 196. When the cover 192 is closed, the humidify element 186 is contracted and stored in the inner space 194. On the other hand, when the cover 192 is opened, the humidify element 186 is extended and deformed so that a part thereof is projected to the outer side of the reservoir 190. Namely, the plurality of humidify segments 188 of the humidify element 186 are displaced by external force having the holding positions as the boundaries. When liquid such as water is supplied to the inner space 194, the water spreads over the humidify element 186 by capillary. Then, water evaporation effect is performed from the humidify element 186. In this embodiment, one end of the humidify element 186 is attached to the reservoir 190 being free to attach and detach. However, it is also possible that one end of the humidify element 186 is fixed to a retain arm (not shown in figures) formed at the cover 192 being free to attach and detach, and the other end is a free end which is not fixed to the reservoir 190 side. With this structure, the humidify element 186 can also be contracted and stored in the inner space 194 of the reservoir 190, in the state that the cover 192 is closed.

The Tenth Embodiment

Figure 23:
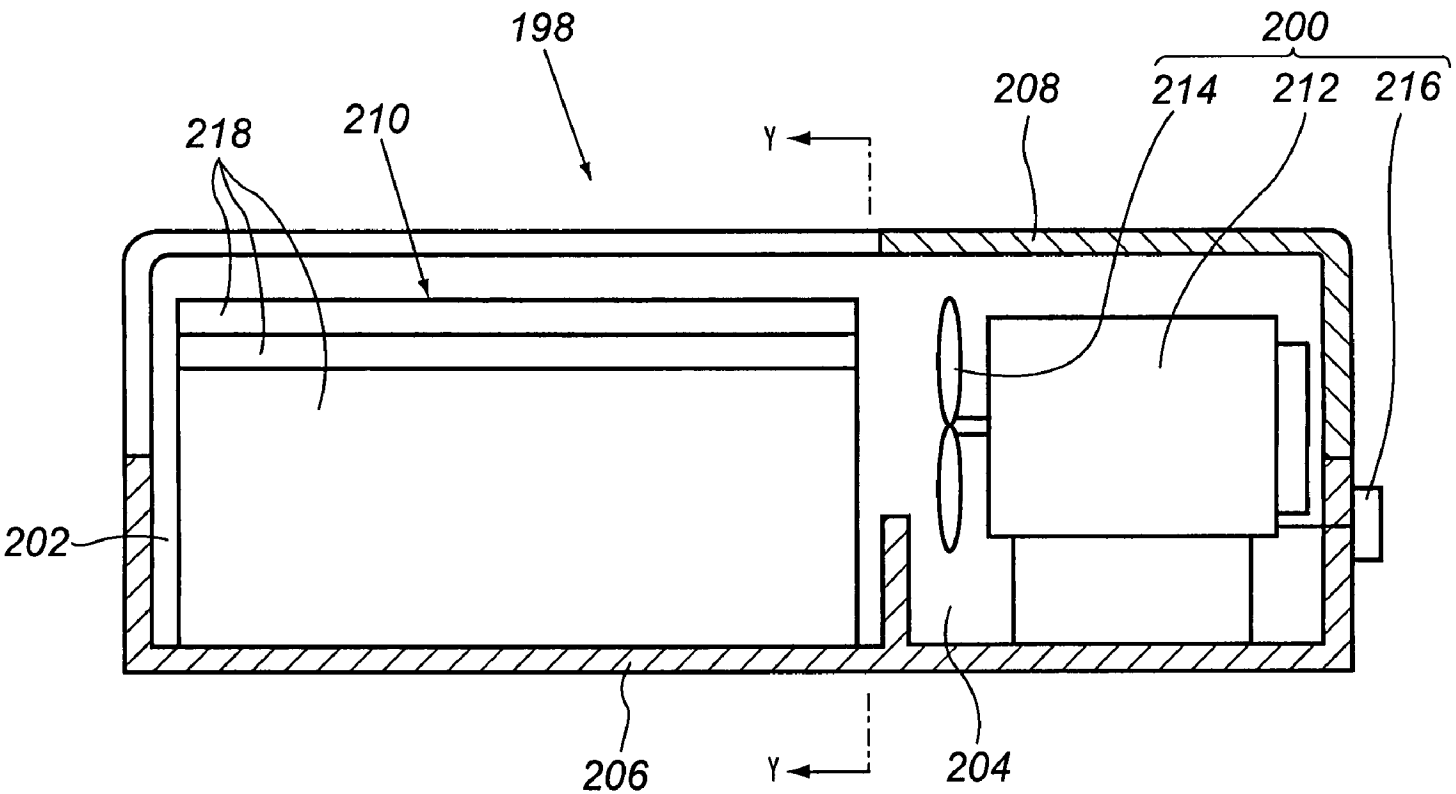
FIG. 23 is a sectional view showing another embodiment of a natural evaporation type humidifier of the present invention.
Figure 24:
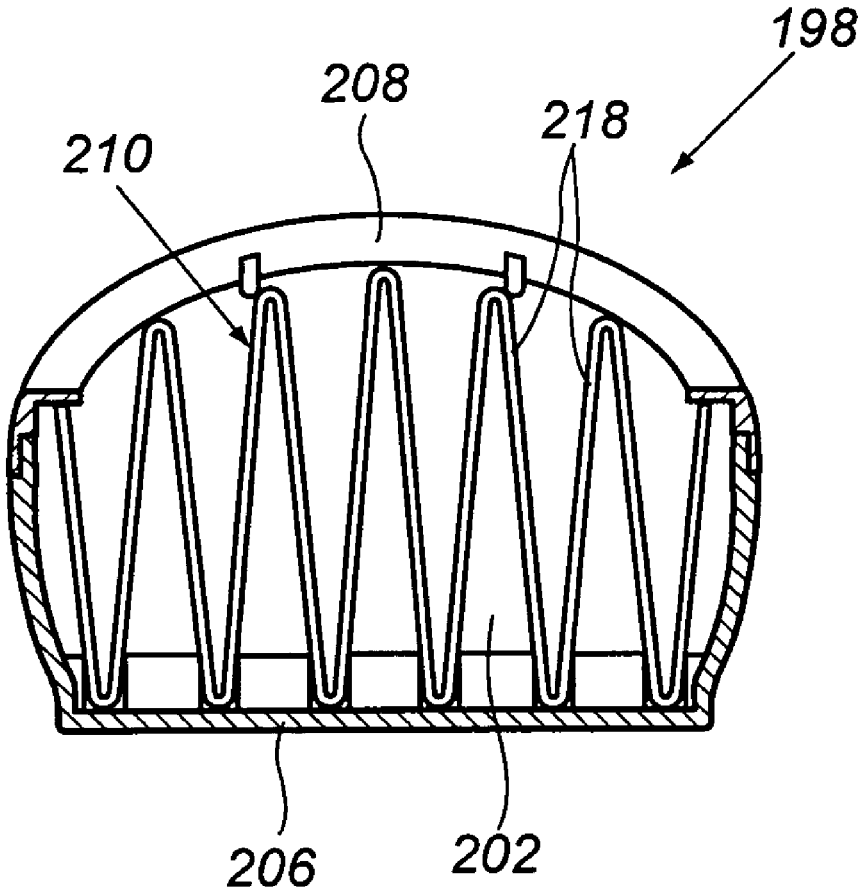
FIG. 24 is a sectional view at Y-Y line in FIG. 23.
Figure 25:
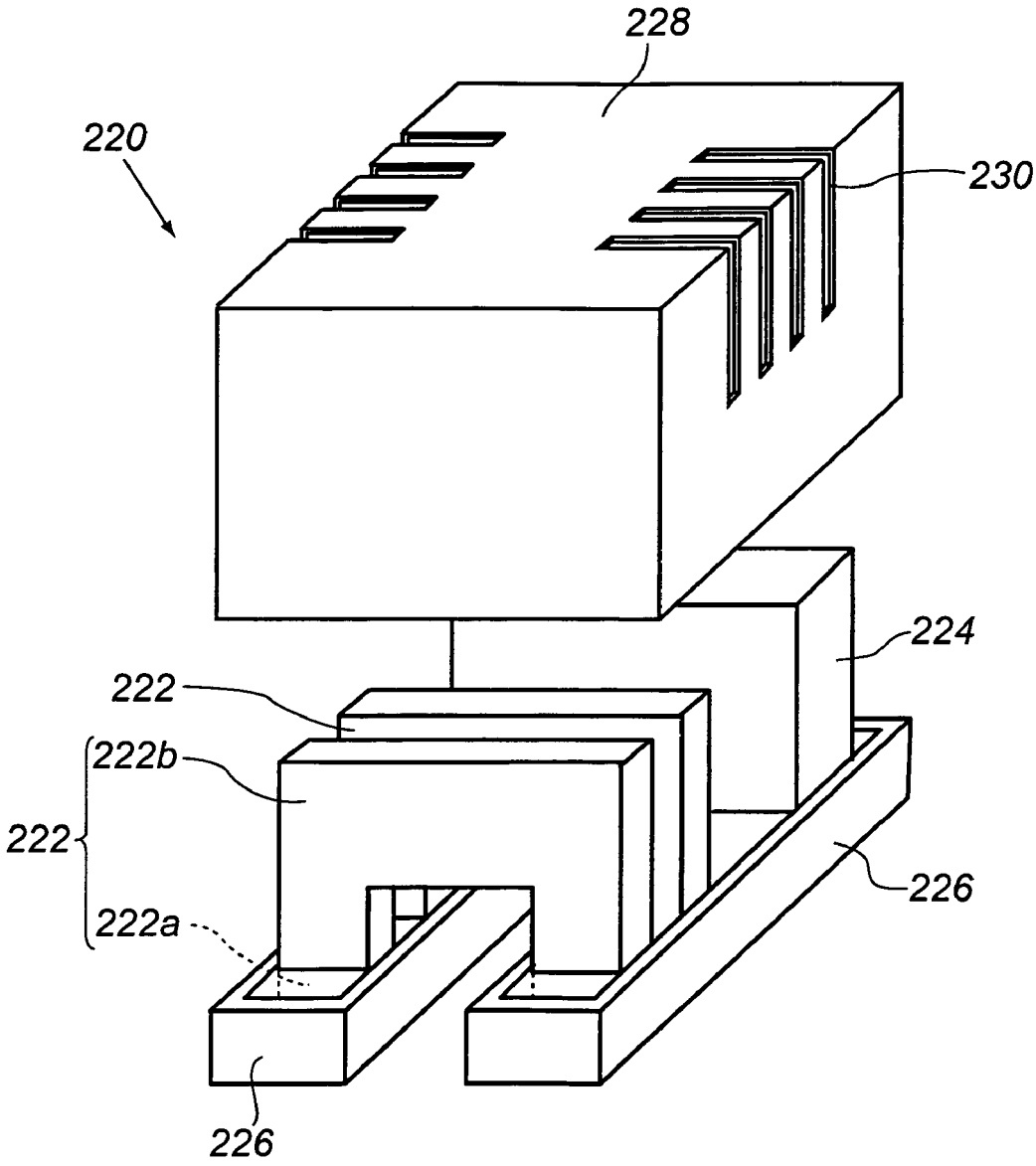
FIG. 25 is a disassembled perspective view showing a natural evaporation type humidifier in the prior art.

Further, another embodiment of the present invention is explained in the following. FIG. 23 is a sectional view showing a natural evaporation type humidifier of the tenth embodiment of the present invention. FIG. 24 is a sectional view at Y-Y line in FIG. 23. The humidifier 198 of the tenth embodiment comprises a blower 200, a reservoir 206 as one case portion which has a first space 202 as a water reservoir and a second space 204 storing the blower 200, a cover 208 as the other case portion which covers the reservoir 206, and a bellows-shaped humidify element 210 which is disposed in the first space 202 being free to extend and contract by being folded as a zigzag shape. The blower 200 has a motor 212, a fan 214, and a switch 216. A plurality of humidify segments 218 are formed by folding the humidify element 210. All the humidify segments 218 are disposed so as to be parallel to the direction of the wind generated by the blower 200. A part of every humidify segment 218 which is disposed in the first space 202 as the water reservoir is located at the vicinity of the bottom portion of the first space 202. Here, in this embodiment, the blower 200 is disposed in the reservoir 206. However, it is also possible to dispose the blower 200 separately from the reservoir 206.

At the time of usage of the humidifier 198, when water is supplied to the first space 202 as the water reservoir, a part of every humidify segment 218 is soaked in the water, namely, liquid. Then, the upper side of all the humidify segments 218 is moistened with water rapidly by capillary. Then, when wind is generated by the blower 200 towards the humidify element 210 which is exposed above the water, the wind passes along the surfaces of the plurality of humidify segments 218. Therefore, water is effectively evaporated from the humidify segment 218, and room air can be humidified. With the tenth embodiment, the velocity to the front side by the blower 200 is far beyond the range of FIG. 5 to the right side of the graph. Then, the humidifying amount corresponding to the velocity to the front side is on the extension line of line (A) which is far beyond the range of the FIG. 5. Therefore, great effect can be obtained. This blower 200 can also be applied to the first through the eighth embodiments.

INDUSTRIAL APPLICABILITY

With a natural evaporation type humidifier of the present invention, by storing a humidify element in an inner space of a case which is free to open and close, downsizing and lightening can be achieved. Therefore, it is possible to carry the natural evaporation type humidifier to anywhere such as a hotel, and use it easily. When the humidifier is not used, the humidify element is contracted and stored in the case by closing the case. Therefore, the humidifier can be downsized and portable. On the contrary, at the time of usage with the case opened, since the humidify element extends and deforms, the humidifying surface area is enlarged and sufficient humidifying capability can be obtained. Further, when the case is opened, the area to touch air can be enlarged by deforming the humidify element. Further, by having the structure that the humidify element is free to attach to and detach from the case, the humidify element can be appropriately replaced when the water evaporation capability decreased due to long term usage. Therefore, it is possible to use the humidifier for a long time while maintaining sanitary conditions. Furthermore, by disposing slits or notches at the humidify element, passing of air can be improved and the humidifying capability can be improved. In addition, by disposing slits or notches at the fold portion, the humidify element becomes easy to be folded.

With a natural evaporation type humidifier of the present invention, by soaking a part of every humidify segment which constitutes the humidify element in water, the distance between the portion which is soaked in water and the top end of every humidify segment becomes uniformed. Therefore, water can spread easily, and rapid humidifying can be performed. Further, by forming the humidify element as a bellows shape being free to extend and contract, increasing of specific number of humidify segment and downsizing can be achieved. Therefore, lightening and cost reduction can be performed while increasing the humidifying capability. By having a structure that the case comprises a first case portion and a second case portion, and an inner space in which the humidify element is stored is disposed at both case portions, an even larger humidify element can be utilized. Further, by having a structure that the case comprises a first case portion and a second case portion, and an engage means which is disposed at each case portion, the opened state of the case can be reliably maintained. Furthermore, when the humidify element receives artificial wind by a blower, the humidifying capability can be further improved due to the synergistic effect with the slits etc.

With a humidify element of the present invention, by forming a plurality of humidify segments by folding a sheet-shaped member, a plurality of humidify segments can be formed at low cost. Further, by having a structure that the plurality of humidify segments can be displaced by external force with a folding position as the center, the humidify element can automatically touch air when the cover of the case is opened. When the sheet-shaped member is folded into two along the center fold portion, and folded thereafter at the plurality of sectional fold portions into a bellows shape, the humidify segments can be disposed in two lines while changing positions alternately. Therefore, specific number of humidify segments can be increased. Further, when the center fold portion to fold into two is formed as a zigzag shape and not linear, and slits are formed at the center fold portion, even a thick sheet for the humidify element can be easily folded into two along the center fold portion. Further, by disposing slits at the humidify segment or the sectional fold portion, the humidifying capability can be improved due to the passing of air though the slits, and it becomes easy to be folded at the sectional fold portion. When the slit formed at the humidify segment or the sectional fold portion is wave-shaped, the air amount passing through the slit can be increased. When a part of every humidify segment is bound up by a connect segment, and the bound position is located at the bottom of the case, water spreads to every humidify segment even when the water in the case is decreased. Therefore, satisfactory humidifying efficiency can be maintained for a long time. Further, when the plurality of humidify segments are connected at every one end by a connect portion, and the connected portion is disposed at the bottom of the case, water spreads to every humidify segment even when the water in the case is decreased. Therefore, satisfactory humidifying efficiency can be maintained for a long time.

With a humidifier case of the present invention, by disposing a link portion to which the humidify element is fixed, the humidify element can easily be attached to and detached from the humidifier case. Further, by disposing closure retaining engage means which mutually engage at both a reservoir and a cover to retain a closed state, and disposing open retaining engage means which mutually engage at both the reservoir and the case to retain a opened state, simple and low cost engage means can be formed. When the humidifier case is constituted by a reservoir and a cover, and a liquid discharge gap which connects the inside and the outside of the reservoir is formed at the reservoir, water in the reservoir can be discharged with the cover closed. Therefore, water can be discharged without wetting the hands. When a pin to fit with the humidify element is disposed in the reservoir, locating of the humidify element and preventing displacement of the humidify element within the reservoir can be performed.

The invention claimed is:

1. A natural evaporation type humidifier, comprising:

a humidifying element, which is absorptive, including a plurality of humidifying segments by folding a sheet-shaped absorptive member; and a case which is free to open and close having an inner space where said humidifying element is stored, wherein a position of said humidifying element changes when said case is opened.

2. The natural evaporation type humidifier according to claim 1, wherein said humidifying element deforms and extends when said case is opened.

3. The natural evaporation type humidifier according to claim 1, wherein said humidifying element is free to attach to and detach from said case.

4. The natural evaporation type humidifier according to claim 1, wherein a slit or a notch is formed at said humidifying element.

5. The natural evaporation type humidifier according to claim 4, wherein said slit or said notch is wave-shaped.

6. The natural evaporation type humidifier according to claim 1, wherein said inner space is a liquid reservoir to store liquid for moistening said humidifying element.

7. The natural evaporation type humidifier according to claim 6, wherein said plurality of humidifying segments are connected by a connecting portion, wherein a part of every humidifying segment is soaked in the liquid in said liquid reservoir.

8. The natural evaporation type humidifier according to claim 7, wherein said connecting portion to connect said plurality of humidifying segments are a plurality of fold portions, and said plurality of humidifying segments are bellows-shaped by folding said plurality of fold portions.

9. The natural evaporation type humidifier according to claim 8, wherein a slit or a notch is formed at the position of said fold portion of said humidifying element.

10. The natural evaporation type humidifier according to claim 9, wherein said slit or said notch is wave-shaped.

11. The natural evaporation type humidifier according to claim 1, wherein said case comprises a first case portion having a first open retaining engagement device and a second case portion having a second open retaining engagement device to engage with said first open retaining engagement device, and wherein said first case portion and said second case portion are fixed by engaging said first open retaining engagement device and said second open retaining engagement device, when said first case portion and said second case portion are opened.

12. The natural evaporation type humidifier according to claim 1, wherein said case comprises a first case portion and a second case portion, and said inner space for storing said humidifying element is formed in both of said first case portion and said second case portion, and wherein one end of said humidifying element is fixed being free to attach to and detach from said first case portion, and the other end of said humidifying element is fixed being free to attach to and detach from said second case portion.

13. The natural evaporation type humidifier according to claim 12, wherein one end of one humidifying element is fixed to said first case portion, and one end of the other humidifying element is fixed to said second case portion, and wherein the other ends of said humidifying elements which are not fixed to said case are connected by a deformable connect member.

14. The natural evaporation type humidifier according to claim 1, wherein said case comprises a first case portion and a second case portion, and one end of said humidifying element is attached to said first case portion, and the other end is attached to said second case portion, and wherein a water receiving portion is disposed as a liquid reservoir made of water-repellant material being free to extend and contract, as one end is attached to said first case portion and the other end is attached to said second case portion.

15. The natural evaporation type humidifier according to claim 14, wherein said humidifying element is free to attach to and detach from said first case portion and said second case portion.

16. The natural evaporation type humidifier according to claim 14, wherein said water receiving portion is free to attach to and detach from said first case portion and said second case portion.

17. The natural evaporation type humidifier according to claim 1, wherein a first locating device is formed in said case to engage with said humidifying element, and a second locating device is formed at said humidify element to engage with said first locating device.

18. The natural evaporation type humidifier according to claim 1, comprising a blower at the vicinity of said humidifying element, wherein said humidifying element receives blown air from said blower.

19. A humidifying element comprising a plurality of humidifying segments by folding a sheet-shaped absorptive member into approximately half in a longitudinal direction along a center fold portion that is formed as a zig-zag shape and a plurality of sectional fold portions that is formed in a direction approximately perpendicular to the center fold portion to create alternate plurality of humidifying segments.

20. The humidifying element according to claim 19, wherein said plurality of humidifying segments are displaced having the folding position as a boundary.

21. The humidifying element according to claim 19, wherein a slit or a notch is formed at said humidifying segment.

22. The humidifying element according to claim 19, wherein a slit is formed along said center fold portion.

23. The humidifying element according to claim 19, wherein said plurality of humidifying segments folded into two along said center fold portion are folded approximately perpendicular to said center fold portion at said plurality of sectional fold portions into a bellows shape.

24. The humidifying element according to claim 23, wherein a slit or a notch is formed at said sectional fold portion.

25. The humidifying element according to claim 23, wherein the folding direction changes every time said center fold portion crosses said sectional fold portion.

26. The humidifying element according to claim 23, comprising:

a connecting segment which connects to at least one humidifying segment for binding up one end of all said plurality of humidifying segments;

a first engagement device which is formed at said connect segment; and a second engagement device which is formed at least at one humidifying segment for engaging with said first engagement device.

27. The humidifying element according to claim 26, wherein said first engagement device is one of an insert segment and a slit, and said second engagement device is the other of an insert segment and a slit.

28. The humidifying element according to claim 19, wherein one end of the plurality of humidifying segments is connected by a connecting portion.

29. The humidifying element according to claim 28, wherein a slit or a notch is formed at said humidifying segment.

30. The humidifying element according to claim 29, wherein said slit or said notch is wave-shaped.

31. The natural evaporation type humidifier according to claim 1, wherein the case includes a link portion to which said humidifying element is fixed being free to attach and detach.

32. The humidifier case according to claim 31, comprising a first case portion and second case portion;

wherein said link portion is formed at least at either said first case portion or said second case portion, being an arm portion to sandwich a part of said humidifying element by forming a gap with an inner wall of said first and second case portions.

33. The humidifier case according to claim 32, comprising:

a first closure retaining engagement device which is disposed at said first case portion to retain a state that said case is closed; and a second closure retaining engagement device which is disposed at said second case portion to engage with said first closure retaining engagement device.

34. The humidifier case according to claim 33, wherein said first closure retaining engagement device is a deform member which is displaced by external force, and said second closure retaining engagement device is a projection which is disposed at a cover, and wherein said projection links with and unlinks from said deform member in accordance with the displacement of said deform member.

35. The humidifier case according to claim 32, comprising:

a first open retaining engagement device which is disposed at said first case portion to retain a state that said case is opened; and a second open retaining engagement device which is disposed at said second case portion to engage with said first open retaining engagement device.

36. The humidifier case according to claim 32, wherein one of said first case portion and said second case portion is a reservoir which has said inner space, and the other is a cover to open and close the opening portion of said reservoir, and wherein a liquid discharge gap for connecting said inner space with outside is formed at said reservoir.

37. The humidifier case according to claim 32, wherein one of said first case portion and said second case portion is a reservoir which has said inner space, and the other is a cover to open and close the opening portion of said reservoir, and wherein a retaining device for retaining said humidifying element is formed in said reservoir.

38. The humidifier case according to claim 32, wherein one of said first case portion and said second case portion is a reservoir which has said inner space, and the other is a cover to open and close the opening portion of said reservoir, and wherein a locating device for engaging with said humidifying element is formed in said reservoir.

39. The natural evaporation type humidifier according to claim 1, wherein said sheet-shaped member is folded along a central fold portion that is formed as a zig-zag shape.

40. The humidifier element according to claim 19, wherein a portion of neighboring sectional fold portions do not contact each other.

* * * * *